US009542813B2

(12) United States Patent
Gupta et al.

(10) Patent No.: US 9,542,813 B2
(45) Date of Patent: Jan. 10, 2017

(54) SYSTEM AND METHOD FOR ALLOWING PLAYERS TO PLAY MATCHING GAMES WITH CARD SYMBOLS

(71) Applicant: GSN Games, Inc., San Francisco, CA (US)

(72) Inventors: Sumit Gupta, Fremont, CA (US); Vikas Gupta, San Francisco, CA (US)

(73) Assignee: GSN Games, Inc., San Francisco, CA (US)

( * ) Notice: Subject to any disclaimer, the term of this patent is extended or adjusted under 35 U.S.C. 154(b) by 313 days.

(21) Appl. No.: 14/083,903

(22) Filed: Nov. 19, 2013

(65) Prior Publication Data

US 2015/0141111 A1 May 21, 2015

(51) Int. Cl.
*G07F 17/32* (2006.01)

(52) U.S. Cl.
CPC ..... *G07F 17/3286* (2013.01)

(58) Field of Classification Search
None
See application file for complete search history.

(56) References Cited

U.S. PATENT DOCUMENTS 2,574,058 A 11/1951 Porter
2,724,392 A 11/1955 Cooper
2,896,648 A 7/1959 Lazarus
3,428,060 A 2/1969 Spivey
4,401,476 A 8/1983 Klaiber
4,448,209 A 5/1984 Lindsay
4,560,171 A * 12/1985 Anthony ..... A63F 1/00 273/269
5,186,193 A 2/1993 Gullberg et al.
5,291,827 A 3/1994 Liers et al.
5,482,289 A 1/1996 Weingardt
5,490,460 A 2/1996 Soble et al.
5,614,027 A 3/1997 Dunn et al.
5,636,571 A 6/1997 Abrahamson
5,674,827 A 10/1997 Kawashima et al.
5,935,002 A 8/1999 Falciglia
6,044,852 A 4/2000 Epperson, Jr. et al.
6,079,711 A * 6/2000 Wei ..... A63F 1/00 273/269
6,409,173 B1 * 6/2002 Tri ..... A63F 3/065 273/269

(Continued)

*Primary Examiner* — Tramar Harper
(74) *Attorney, Agent, or Firm* — Knobbe, Martens, Olson & Bear, LLP

(57) ABSTRACT

A system for allowing players to play a bingo-type game is described herein. The system includes a system controller that is coupled to a plurality of user computing devices. The system controller is configured to display the bingo-type game including a plurality of symbol positions being displayed in a grid. Each symbol position is associated with a card symbol. The system controller randomly selects a plurality of player symbols, displays the player symbols in the symbol positions, randomly selects a plurality of bingo symbols, determines if each one of the plurality of bingo symbols matches a corresponding one of the plurality of player symbols, identifies each card symbol associated with each matched player symbol, determines a combination formed by each of the identified card symbols, and provides the player an award if the determined combination of card symbols forms a winning combination.

18 Claims, 15 Drawing Sheets

(56) References Cited

U.S. PATENT DOCUMENTS 6,656,044 B1 12/2003 Lewis
6,668,844 B2 12/2003 Lund et al.
6,821,355 B1 11/2004 Taylor et al.
7,837,550 B2 11/2010 Odom
8,123,607 B2 2/2012 Van Asdale
8,201,827 B2 6/2012 Weingardt
8,387,985 B1 3/2013 Itkis et al.
8,602,864 B1 * 12/2013 Lewis ..... G07F 17/3244 463/18
2002/0017209 A1 2/2002 Gutfleisch et al.
2002/0083958 A1 7/2002 Bran
2003/0010363 A1 1/2003 Cotte et al.
2003/0062067 A1 4/2003 Meyer et al.
2003/0062071 A1 4/2003 Sorbo et al.
2003/0064772 A1 4/2003 Tempest et al.
2003/0125101 A1 * 7/2003 Campo ..... G07F 17/32 463/19
2004/0242313 A1 12/2004 Munoz
2005/0059470 A1 3/2005 Cannon
2005/0059471 A1 3/2005 Cannon
2005/0101387 A1 * 5/2005 Wolf ..... G07F 17/3286 463/42
2005/0119042 A1 6/2005 Chamberlain et al.
2006/0035699 A1 2/2006 Falciglia, Sr.
2006/0052160 A1 3/2006 Saffari
2006/0079309 A1 * 4/2006 Walker ..... G07F 17/32 463/13
2006/0121977 A1 * 6/2006 Odom ..... A63F 3/062 463/19
2006/0252493 A1 * 11/2006 Tribout ..... A63F 3/062 463/19
2007/0060333 A1 * 3/2007 Englman ..... G07F 17/3267 463/29
2009/0247258 A1 10/2009 Anderson
2012/0009987 A1 1/2012 Dumont et al.
2014/0018143 A1 1/2014 Yarbrough
2014/0274280 A1 9/2014 Macbeth et al.
2015/0038211 A1 2/2015 Santosh et al.
2015/0141110 A1 5/2015 Gupta et al.

* cited by examiner

SYSTEM AND METHOD FOR ALLOWING PLAYERS TO PLAY MATCHING GAMES WITH CARD SYMBOLS

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to a system for allowing players to play matching games and more particularly, to methods and systems for allowing players to play bingo-type games that include card symbols and winning combinations being defined as a combination of card symbols.

BACKGROUND OF THE INVENTION

At least some known gaming systems display video based games such as bingo-type games that allow players to purchase bingo cards for use in playing the bingo-type game. Each bingo card includes a randomly selected sub-set of numbers from a pre-defined set of numbers. During play of the bingo-type game, the gaming system conducts a draw in which a plurality of numbers are randomly selected from the predefined set of numbers. During the draw, the player compares the drawn number with the numbers displayed on the purchased bingo cards to determine if a match occurs between the drawn number and the numbers displayed on the bingo cards. The player marks, or daubs, each corresponding matched number on the bingo card and indicates a winning outcome when the matched numbers form a complete row and/or column on the bingo card. The gaming system verifies the winning outcome and responsively provides an award to the player based on the winning outcome indicated on the bingo card.

Over time, during game play, the player may become frustrated because the chances of receiving an award are based only on the number of matches made between the numbers selected during the draw and the predefined set of numbers displayed on the player's bingo card. Accordingly, new features are necessary to appeal to player interest and enhance excitement in order to entice longer play and increased profitability. The present invention is directed to satisfying these needs.

SUMMARY OF THE INVENTION

The invention is generally directed to systems and methods for allowing players to play bingo-type games that include secondary symbols such as for example, card symbols, and winning combinations being defined as a combination of card symbols.

In one aspect of the invention, a system for allowing players to play a bingo-type game is provided. The system includes a database and a system controller coupled to the database. The database includes a plurality of game symbols including a plurality of bingo symbols and at least one secondary symbol. The system controller configured to receive, from at least one user computing device, a request from a player to play the bingo-type game and responsively display the bingo-type game on the at least one user computing device. The bingo-type game includes a plurality of symbol positions being displayed in a grid, each symbol position being associated with a secondary symbol. The system controller randomly selects a plurality of primary symbols contained in the database and displays the selected plurality of primary symbols in the plurality of symbol positions. The system controller also randomly selects a plurality of bingo symbols, determines if each one of the plurality of bingo symbols matches a corresponding one of the plurality of primary symbols, identifies each secondary symbol associated with each matched primary symbol, determines a combination formed by each of the identified secondary symbols, and provides the player an award if the determined combination of secondary symbols forms a winning combination of secondary symbols.

In another aspect of the invention, a method for allowing players to play a bingo-type game with a gaming system is provided. The gaming system includes a controller in communication with a display device and a user input device. The method includes displaying the bingo-type game on the display device including a plurality of symbol positions being displayed in a grid. Each symbol position is associated with a secondary symbol. The method includes randomly selecting a plurality of primary symbols and displaying the selected primary symbols in the plurality of symbol positions. The method also includes randomly selecting a plurality of bingo symbols, determining if each one of the plurality of bingo symbols matches a corresponding one of the plurality of primary symbols, identifying each secondary symbol associated with each matched primary symbol, determining a combination formed by each of the identified secondary symbols, and providing the player an award if the determined combination of secondary symbols forms a winning combination of secondary symbols.

In yet another aspect of the invention, one or more non-transitory computer-readable storage media, having computer-executable instructions embodied thereon, is provided. The computer-executable instructions, when executed by at least one processor, cause the processor to display a bingo-type game on a display device including a plurality of symbol positions being displayed in a grid. Each symbol position being associated with a secondary symbol. The processor randomly selects a plurality of primary symbols and displays the selected plurality of primary symbols in the plurality of symbol positions. The processor also randomly selects a plurality of bingo symbols, determines if each one of the plurality of bingo symbols matches a corresponding one of the plurality of primary symbols, identifies each secondary symbol associated with each matched primary symbol, determines a combination formed by each of the identified secondary symbols, and provides the player an award if the determined combination of secondary symbols forms a winning combination of secondary symbols.

BRIEF DESCRIPTION OF THE DRAWINGS

Other advantages of the invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
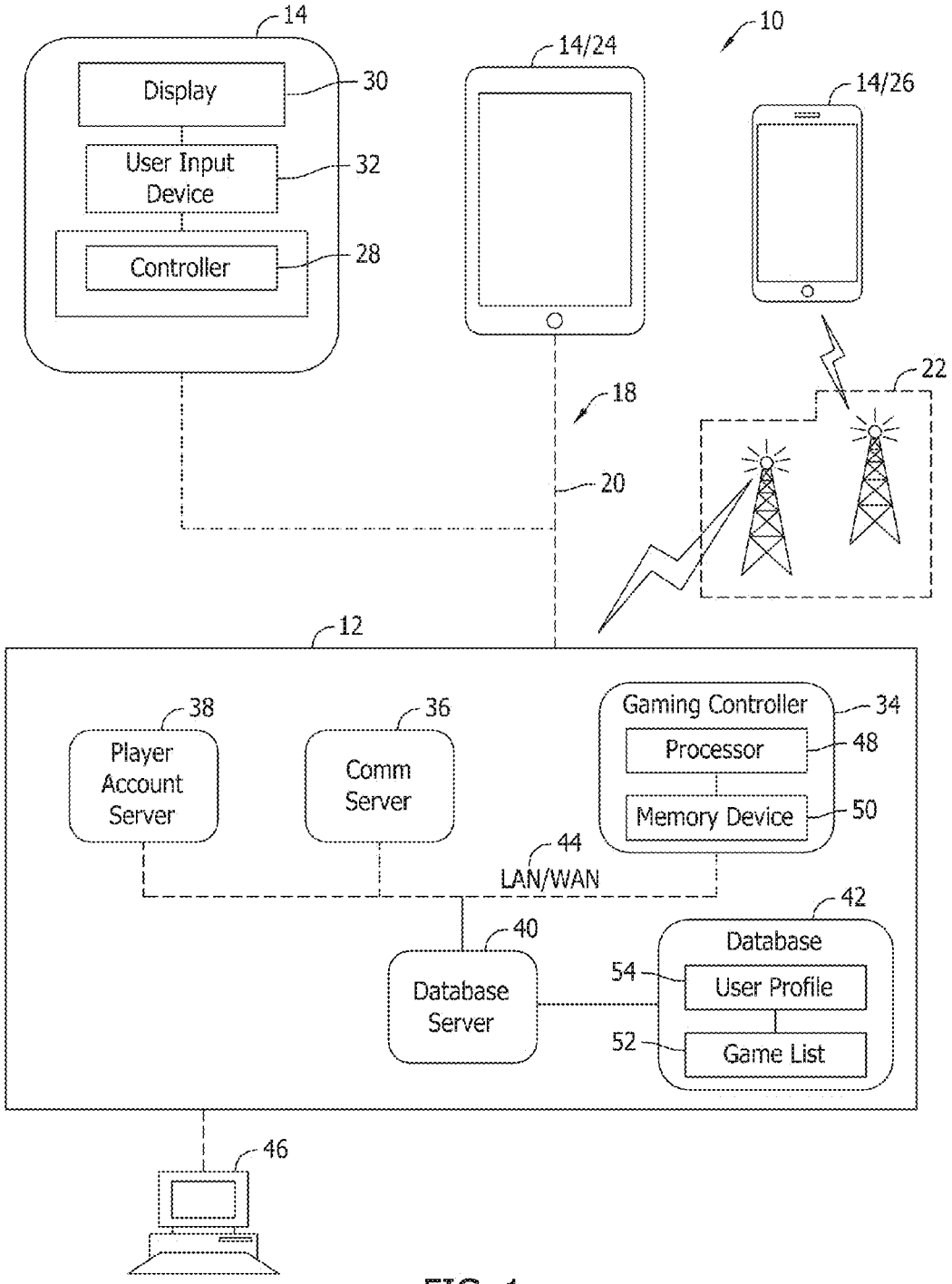
FIG. 1 is a schematic representation of an exemplary system for allowing a player to play a bingo-type game, according to an embodiment of the invention.

The exemplary embodiments herein relate to matching-type games. It should be understood that each of the methods and individual steps recited herein may be partially or wholly carried out in a variety of ways and/or systems, which may include, but are not limited to, a live dealer physically dealing playing cards in a casino, a dealer providing a plurality of bingo cards that includes randomly selected bingo symbols, an electronic gaming machine (EGM) for use by one or more players, a multiplayer platform which may include a player interface such as a touchscreen display and involve physical or virtual bingo cards, a home computer and/or portable computing device, such as a tablet computer or mobile phone capable of communicating with a network or over the Internet, global telecommunication network or world wide web.

It should further be understood that the invention is directed to, among other things, methods of providing, conducting and resolving wagering games that include a sequence of controlled and concrete transformative events. Some of these events may involve wagering, the generation of random data, the application of randomly-generated data to predefined rules, the determination of wager outcomes in accordance with preset outcome determining criteria, the notification of such outcomes, awarding of payouts and collecting of wagers. The generation of random data may be facilitated by computerized and/or physical implements. The transformative events may also include parsing of the data for comparative purposes with preset criteria to determine an outcome in a second, bonus or associated wagering game.

With reference to the drawings and in operation, the invention overcomes at least some of the disadvantages of known systems by providing, among other things, systems and methods which enable a player to play a bingo-type game that includes matching primary symbols, identifying secondary symbols associate with the matched primary symbols, and determining winning game outcomes based on the combination of identified secondary symbols. Moreover, the systems and methods are configured to allow a player to play a card-type game within the bingo-type game by defining the winning combinations as including a solitaire-type order of secondary symbols such as, for example, card symbols including a descending value of card symbols with alternative card colors. For example, the system and methods of the invention are configured to allow a player to purchase a bingo card that includes a plurality of primary symbols being displayed in a plurality of symbol positions, with each symbol position being associated with a card symbol. The system randomly selects a plurality of bingo symbols and determines whether the selected bingo symbols match the primary symbols. The system also identifies a card symbol associated with each matched primary symbol and provides an award to the player if the combination formed with the identified card symbols includes the winning solitaire-type combination. By providing an award to the player based on the combination of secondary symbols associated with each matched primary symbol, the player's expectation of achieving a winning outcome with the purchased bingo card is increased, thus increasing the amount of bingo cards purchased by the player and increasing the amount of revenue received from the purchases.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

FIG. 1 is a schematic representation of the system 10, according to an embodiment of the invention. In the illustrated embodiment, the system 10 includes a server system 12 that is coupled to one or more user computing devices 14. Each user computing device 14 is configured to transmit and receive data to and/or from the server system 12 to display graphical interfaces 16 (shown in FIGS. 4-8) to enable a user to participate in bingo-type games via the user computing device 14. In the illustrated embodiment, the server system 12 is coupled to each user computing device 14 via a communications link 18 that enables each user computing device 14 to access the server system 12 over a network 20, such as the Internet, a cellular telecommunications network 22, a wireless network and/or any suitable telecommunication network that enables the user computing devices 14 to access the server system 12. For example, in one embodiment, the user computing device 14 includes a mobile computing device 24, e.g. a smartphone 26 that communicates with the server system 12 via the cellular telecommunications network 22 and/or the Internet. In another embodiment, the user computing device 14 may include a personal computer, laptop, cell phone, tablet computer, smartphone/tablet computer hybrid, personal data assistant, and/or any suitable computing device that enables a user to connect to the server system 12 and display the graphical interfaces 16.

In the illustrated embodiment, each user computing device 14 includes a controller 28 that is coupled to a display device 30 and a user input device 32. The controller 28 receives and transmits information to and from the server system 12 and displays the graphical interface 16 (shown in FIGS. 4-8) on the display device 30 to enable the user to interact with the server system 12 to play the games in accordance with the embodiments described herein. The display device 30 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 32 includes, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data into the controller 28 and/or to retrieve data from the controller 28. Alternatively, a single component, such as a touch screen, a capacitive touch screen, and/or a touchless screen, may function as both the display device 30 and as the user input device 32.

In the illustrated embodiment, the server system 12 includes a gaming controller 34, a communications server 36, a player account server 38, a database server 40, and a database 42. The servers 36, 38, and 40, gaming controller 34, and database 42 are connected through a network 44 such as, for example, a local area network (LAN), a wide area network (WAN), dial-in-connections, cable modems, wireless modems, and/or special high-speed Integrated Services Digital Network (ISDN) lines. Moreover, at least one administrator workstation 46 is also connected to the network 44 to enable communication with the server system 12. Alternatively, the workstation 46 may be coupled to the network 44 using an Internet link or may be coupled through an intranet.

The communications server 36 communicates with the user computing devices 14 and the administrator workstation 46 to facilitate transmitting data over the network 20 via the Internet and/or the cellular network 22, respectively.

The database server 40 is connected to the database 42 to facilitate transmitting data to and from the database 42. The database 42 contains information on a variety of matters, such as, for example, account information related to a user, user profile information, a game type, a number of game symbols associated with a game, a number of bingo symbols associated with a game, a type of bingo symbol, a number of primary and secondary symbols associated with a game, a number of card symbols associated with a game, a characteristic associated with each card symbol, and image data for producing game images and/or screens on the user computing device 14. In one embodiment, the database 42 includes a centralized database that is stored on the server system 12 and is accessed directly via the user computing devices 14. In an alternative embodiment, the database 42 is stored remotely from the server system 12 and may be non-centralized.

The gaming controller 34 includes a processor 48 and a memory device 50 that is coupled to the processor 48. The memory device 50 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 48 to store, retrieve, and/or execute instructions and/or data.

The processor 48 executes various programs, and thereby controls other components of the server system 12 and the user computing device 14 according to user instructions and data received from the user computing devices 14. The processor 48 in particular displays the graphical interfaces 16 (shown in FIGS. 4-8) and executes a game program, and thereby enables the system 10 to generate games and allow the user to play the games in response to user instructions received via the user computing devices 14 in accordance with the embodiments described herein. The memory device 50 stores programs and information used by the processor 48. Moreover, the memory device 50 stores and retrieves information in the database 42 including, but not limited to, image data for producing images and/or screens on the display device 30, and temporarily stores variables, parameters, and the like that are used by the processor 48. In addition, the memory device 50 may store a game list 52 in the database 42 that includes data related to a collection of simulated casino-type games (shown in FIGS. 4-8) that are available for play via the user computing device 14. The simulated casino-type games may include, but are not limited to, a bingo-type game, a video slot game, a keno game, a blackjack game, a video craps game, a video poker game, or any casino-type of game which allows a player to place a wager, play a game, and potentially provide the player an award. In addition, the game list 52 may include game indicia, symbol weights, paytables, and/or winning combination tables which represent relationships between combinations of random numbers, combinations of symbol matches and types of awards associated with each game.

In the illustrated embodiment, the gaming controller 34 includes multiple instances of a game such that each user computing device 14 may play a separate instance of the game simultaneously. In addition, the gaming controller 34 enables players on one or more user computing devices 14 to simultaneously play the same game.

In the illustrated embodiment, the player account server 38 stores information associated with a plurality of user profile accounts and a plurality of corresponding unique user identifiers in a user profile program 54 in the database 42. In the illustrated embodiment, the player account server 38 uses the unique user identifier to identify the user profile account associated with the unique user identifier and provide the user access to the server system 12 to initiate a gaming session via a user computing device 14. In one embodiment, the unique user identifier may include a combination of a username and password. Alternatively, in another embodiment, the unique user identifier may include a personal identification number, or a random identification number assigned to a corresponding user account. For example, in one embodiment, the unique user identifier may include a mobile device identifier, such as, for example, a cellular phone number and/or wireless internet address for identifying a user computing device 14 associated with a user account.

In one embodiment, each user profile account may include personal identification information such as, for example, a user name, address, personal identification number, date of birth, email address, mobile phone number, and/or any suitable information that enables the player account server 38 to identify a user. In addition, the user profile account may include player tracking information such as, for example, a type of game previously played by the player, a frequency in which the player plays a game, the average number of games played over a predefined period of time, the average credit wager the player makes per play of a game, a total amount wagered by the player over a predefined period of time, and/or any other suitable player tracking information. Moreover, the user profile account may include an amount of secondary symbols obtained and/or collected by a corresponding user over multiple game play sessions, as described herein. In addition, the user profile account may also include a list of preferred game categories such as, for example, type of games, amount of wagers made per game, number of games to be played simultaneously, total amount of wagers made during gaming session, and/or any information related to a preferred game environment that enables the system 10 to function as described herein.

In the illustrated embodiment, each user profile account also includes financial account information associated with each user. The financial account information may include, but is not limited to, an amount of game credits available for use in playing games, available monetary funds for use in purchasing game credits, an available game credit account balance, and/or any suitable financial information that enables the system 10 to function as described herein.

In the illustrated embodiment, the workstation 46 includes a display and user input device to enable an administrative user to access the server system 12 to transmit data indicative of the game and/or awards to the database server 40. This enables an administrative user to periodically update the game list, game types, user profile accounts, and/or any suitable data and information that enables the system 10 to function as described herein.

Figure 2:
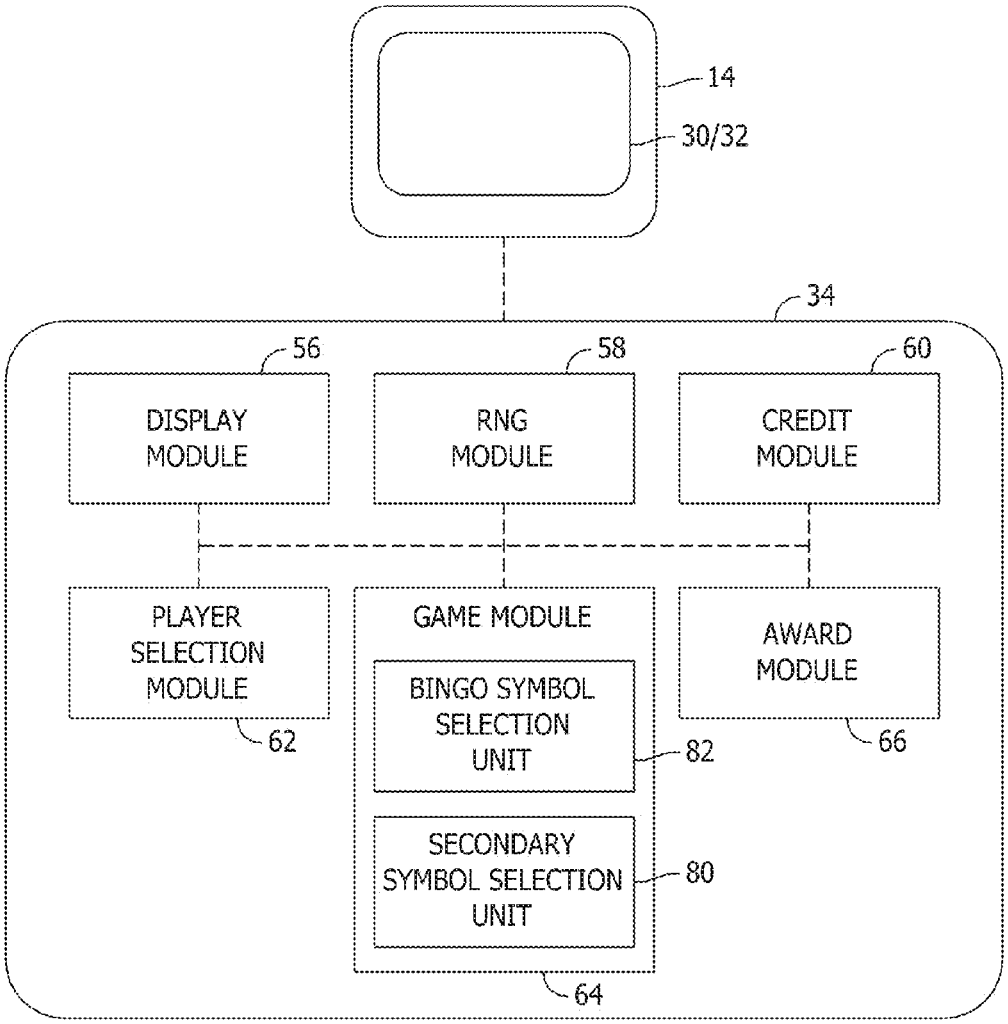
FIG. 2 is a schematic view of a gaming controller that may be used with the system shown in FIG. 1.

FIG. 2 is schematic view of the gaming controller 34. In the illustrated embodiment, the gaming controller 34 includes a display module 56, a random-number generator (RNG) module 58, a credit module 60, a player selection module 62, a game module 64, and an award module 66.

The display module 56 controls the display device 30 to display various images on the graphical interface 16 preferably by using computer graphics and image data stored in the database 42. More specifically, the display module 56 controls game symbols 68 being displayed in a game such as, for example, a bingo-type game 70 (shown in FIG. 4) on the display device 30 by using computer graphics and the image data. In the illustrated embodiment, the display module 56 also displays a plurality of user selection areas 72 (shown in FIG. 4) within the graphical interface 16 that correspond to specific operations that may be initiated by the user. For example, in the illustrated embodiment, the display module 56 displays each game symbol 68 including an associated selection area 72 to enable the user to select each displayed game symbol 68 to indicate a user's selection of the corresponding game symbol 68. Each of the selection areas 72 may receive a user selection input via the user input device 32.

The credit module 60 communicates with the player account server 38 to manage the amount of player's credits available for use in playing the bingo-type game 70. The credit module 60 receives a user selection indicative of a request from a user computing device 14 to play a game including an amount of game credits associated with the selected game. The credit module 60 sends a verification message to the player account server 38 including a unique user identifier and a game credit amount associated with the requested game play. The player account server 38 identifies the user profile account associated with the unique user identifier and determines if sufficient game credits are available in the user profile account as a function of the user request. If the player account server 38 determines sufficient game credits are available in the user profile account, the player account server 38 sends a verification message to the credit module 60 and deducts a corresponding amount of game credits from the user profile account. If the player account server 38 determines that the user profile account does not include a sufficient amount of game credits, the credit module 60 displays a message on the user computing device 14 requesting the user to purchase additional game credits corresponding to the request. In addition, the credit module 60 may also display an amount of game credits included in the user profile account that are available for use in playing and/or wagering on the games.

The game module 64 includes a game program for use in playing a game based on user selection input receive from a user computing device 14. The game module 64 receives game information from the game list 52 included in the database 42 and performs various functions and calculations to play the game according to a set of predetermined game rules and player input. More specifically, the game module 64 retrieves game elements from the database 42, and causes the display module 56 to display the game on the display device 30. The game module 64 receives signals indicative of a user selection input via the user input device 32 and generates an outcome of the game based on the predetermined game rules and the received user selection input, and displays the game outcome on the display device 30.

The RNG module 58 generates and outputs random numbers to the game module 64 for use in playing the game 70. In addition, the game module 64 may use random numbers generated by the RNG module 58 to determine if a winning condition has occurred in the outcome of the game, and to determine whether or not to provide an award to a player. For example, if the game is the bingo-type game 70, the game module 64 uses the RNG module 58 to randomly select one or more bingo cards 74 (shown in FIG. 4) including a plurality of primary symbols such as, for example, player symbols 76 and/or bingo numbers for use during the bingo-type game 70. In addition, the game module 64 uses the RNG module 58 to randomly select a plurality of bingo symbols 78 during a symbol draw. The game module 64 compares the bingo symbols 78 such as, for example, bingo numbers selected during the draw with the player symbols 76 and/or numbers displayed in the selected bingo cards 74 to determine a number of player symbols 76 and/or numbers matching the randomly selected bingo symbols 78.

In the illustrated embodiment, the game module 64 includes a secondary symbol selection unit 80 and a bingo symbol selection unit 82. The secondary symbol selection unit 80 is configured to randomly select a plurality of secondary symbols such as, for example, card symbols 84 (shown in FIGS. 5-7) from a predefined set of card symbols 84 for use in the bingo-type game 70. In the illustrated embodiment, each secondary symbol includes a card symbol 84 is indicative of a playing card and includes one or more characteristics such as, for example, a card suit, card value, card color, and/or any suitable characteristic for use in a card game. For example, in one embodiment, the predefined set of card symbols 84 may include a plurality of card symbols 84 including an "Ace", "King", "Queen", "Jack", "10". "9", "8", "7", "6", "5", "4", "3", and "2" cards from each of four suits, e.g. "spades", "diamonds", "clubs", and "hearts". In another embodiment, the predefined set of secondary symbols 84 includes any game symbol 68 that enables the system 10 to function as described herein.

In the illustrated embodiment, the bingo symbol selection unit 82 is configured to randomly select game symbols 68 from a predefined set of bingo symbols 78 for use in the bingo-type game 70. For example, in one embodiment, the bingo symbol selection unit 82 may be configured to randomly select a plurality of player symbols 76 from the predefined set of bingo symbols 78 for use in the bingo-type game 70, randomly select a plurality of bingo symbols 78 from the predefined set of bingo symbols 78, and determine if each selected player symbol 76 matches a selected bingo symbol 78.

In the illustrated embodiment, the player selection module 62 receives a user selection input from the input device 32, selects player symbols 76 based on the player's selection, and displays a notification indicative of the player's selection on the graphical interface 16. In addition, the player selection module 62 transmits the player's selection to the game module 64 for use in determining if a player's symbol selection matches a selected bingo symbol 78. In one embodiment, the player selection module 62 may receive the selected bingo symbol 78 from the game module 64 and select the corresponding player symbol 76 without input from the user.

In the illustrated embodiment, the game module 64 determines an outcome of the bingo-type game 70 including any determined symbol matches and transmits the game outcome to the award module 66. The award module 66 compares the game outcome with winning combinations stored in a winning combination table to determine if the symbol matches include a winning outcome that is associated with a type of award.

Figure 3:
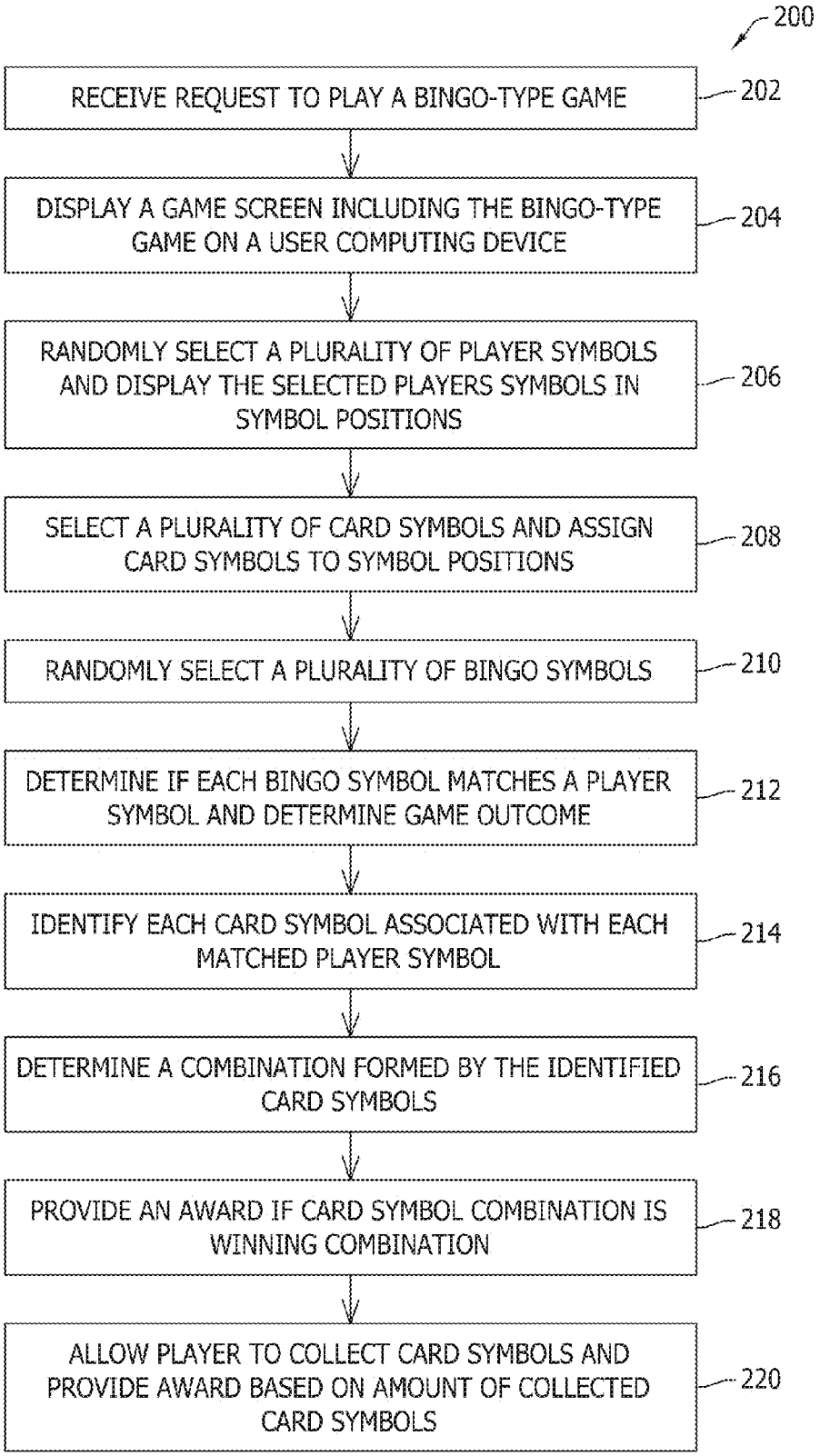
FIG. 3 is a flowchart of a method that may be used with the system shown in FIG. 1 for allowing a player to play a game via a user computing device, according to an embodiment of the invention.
Figure 4:
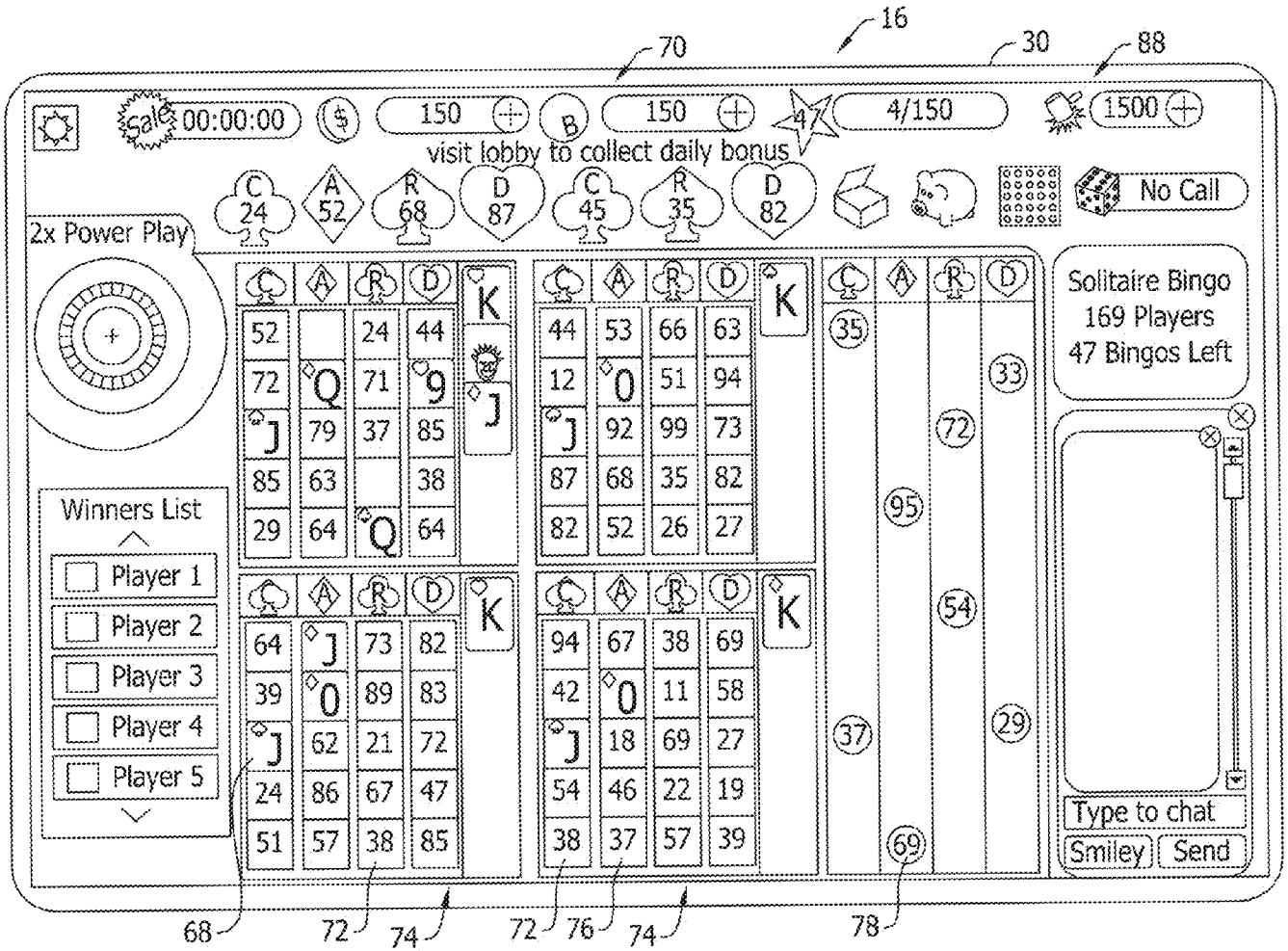
FIG. 4 is an exemplary entertaining graphical display of a bingo-type game that may be used with the method shown in FIG. 3, according to an embodiment of the present invention.
Figure 5:
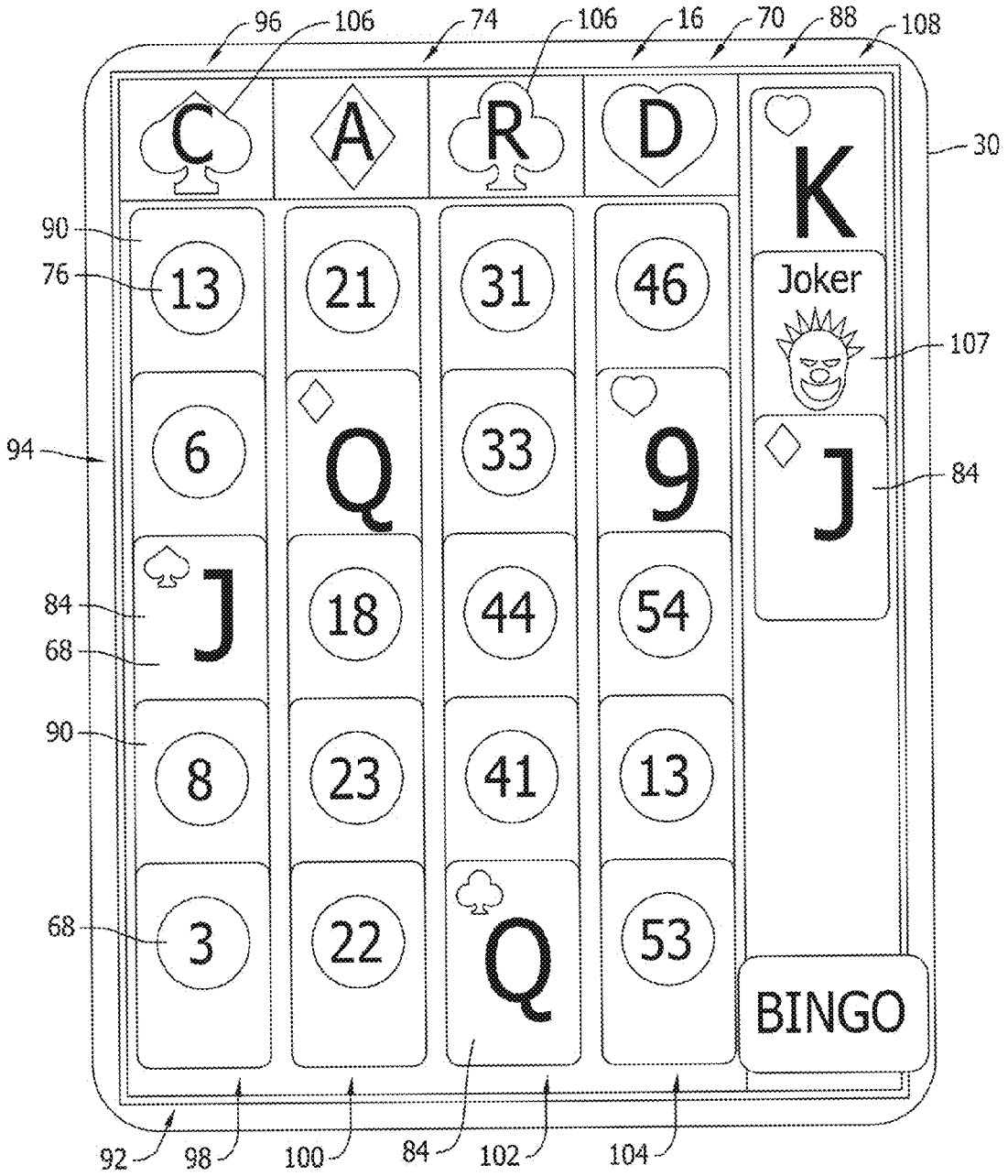
FIG. 5 is another exemplary entertaining graphical display of a bingo-type game that may be used with the method shown in FIG. 3, according to an embodiment of the present invention.
Figure 6:
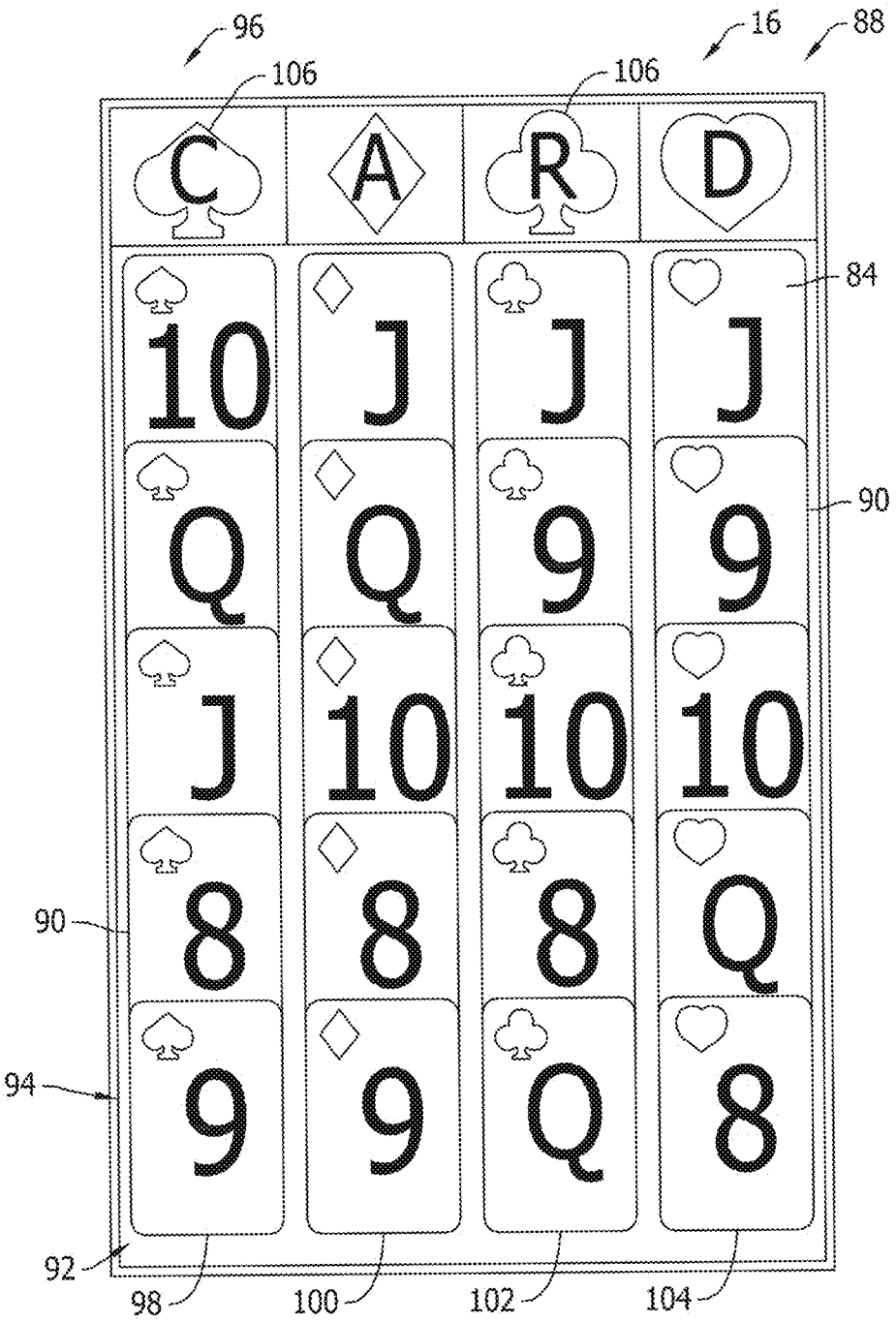
FIGS. 6 and 7 are schematic illustrations of the bingo-type game shown in FIG. 5.
Figure 7:
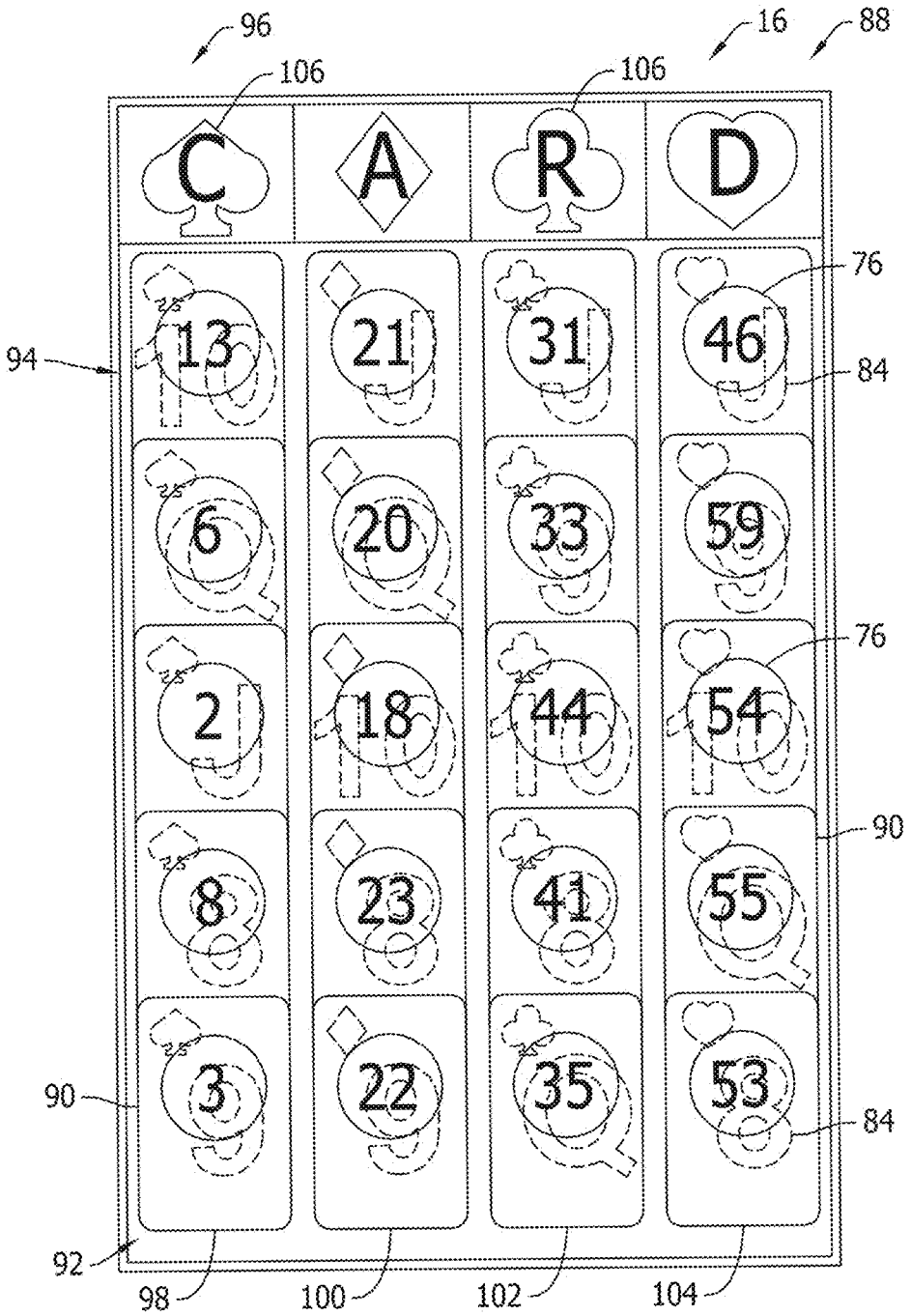
Figure 8:
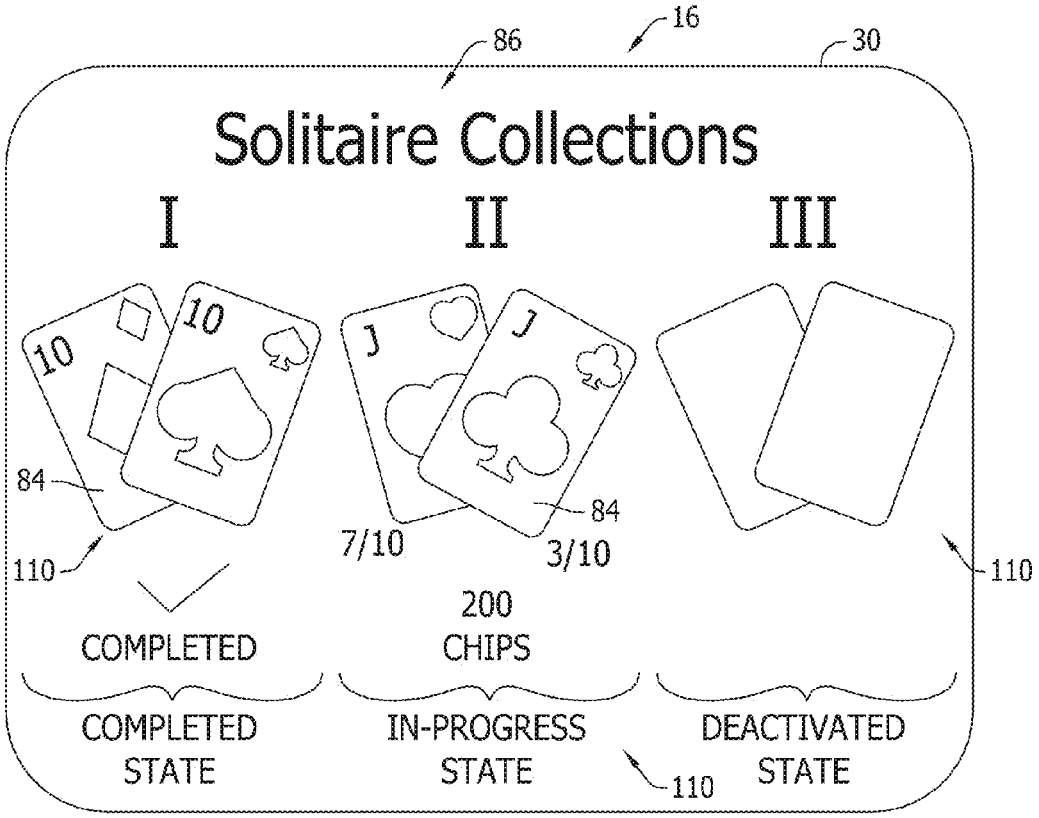
FIG. 8 is an exemplary entertaining graphical display of a collections screen that may be used with the method shown in FIG. 3, according to an embodiment of the present invention.

FIG. 3 is a flowchart of a method 200 that may be used with the system 10 for allowing a player to play a game via a user computing device 14. Each method step may be performed independently of, or in combination with, other method steps. Portions of the method 200 may be performed by any one of, or any combination of, the components of the system 10. FIGS. 4 and 5 are exemplary entertaining graphical displays of the bingo-type game 70 that may be played with the system 10. FIGS. 6 and 7 are schematic illustrations of the bingo-type game 70. FIG. 8 is an exemplary entertaining graphical display of a collections screen 86 that may be displayed by the system 10, according to an embodiment of the present invention. In the illustrated embodiment, entertaining graphical displays for amusement purposes are presented by the user computing device 14 via the display device 30 (shown in FIG. 1) and may receive input (e.g., selections and/or entries) via the user input device 32 (shown in FIG. 1). For example, in one embodiment, a selection may be received via user input device 32 of the user computing device 14 and may be transmitted by the user computing device 14 to the server system 12 via the network 20.

In the illustrated embodiment, in the method step 202, the gaming controller 34 receives a request from a player to play the bingo-type game 70 from a user computing device 14. In one embodiment, the player may submit the request by accessing a website via the communications server 36. In another embodiment, the player may access a mobile website via the cellular network 22. In addition, in one embodiment, the method step 202 may include receiving, by the gaming controller 34, a unique user identifier to validate the request to display the bingo-type game 70. More specifically, the display module 56 may display a login screen (not shown) on the user computing device 14 to request the unique user identifier such as, for example, requesting a username and/or password. The gaming controller 34 receives the unique user identifier and transmits a validation request including the user credentials to the player account server 38. The player account server 38 compares the received unique user identifier with the collection of unique user identifiers contained in the user profile program 54 to validate the unique user identifier, and responsively sends a validation message to the gaming controller 34 if the received unique user identifier is included in the user profile program 54. Upon receiving the validation message from the player account server 38 the gaming controller 34 displays a listing of available games from the game list 52. In addition, in one embodiment, if the received user identifier is not included in the user profile program 54, the gaming controller 34 may prompt the user to establish a user account and/or display the available games without requiring the user to establish a user account and/or verify a user account. In addition, in one embodiment, method step 202 may also include receiving a wager from the player and/or receiving a request to purchase a play of the game with game credits from the corresponding user profile account.

In method step 204, the gaming controller 34 displays a game screen 88 including a game in response to the request received from the player via the user computing device 14. In the illustrated embodiment, the gaming controller 34 displays the bingo-type game 70. However, it should be noted that the gaming controller 34 may display any type of game included in the game list 52 and upon which a player could make a wager and/or purchase a game play including, but not limited to, a slot game, a blackjack game, a video poker game, or any type of game that enables the system 10 to function as described herein. In general, during method step 204, the game module 64 displays the bingo-type game 70 including one or more bingo cards 74. Each bingo card 74 includes a plurality of symbol positions 90 being displayed in a grid 92, and a plurality of player symbols 76 being displayed with each of the symbol positions 90. Each player symbol 76 is selected from a predefined set of bingo symbols 78. In one embodiment, the plurality of bingo symbols 78 may include numbers and/or a combination of letters and numbers. In another embodiment, the plurality of bingo symbols 78 may include a combination of numbers and card suits. Alternatively, the plurality of bingo symbols 78 may include any game symbol that may be selected from a predefined set of associated game symbols.

In one embodiment, the game module 64 may display the game 70 including a plurality of bingo cards 74 determined as a function of the player's wager and/or a number of game plays purchased by the player using game credits. For example, in one embodiment, the game module 64 receives a wager from the player, receives a player selection input indicative of a number of bingo cards 74 to be purchased with the wager for use in the bingo-type game 70, and displays the selected number of bingo cards 74.

In method step 206, the bingo symbol selection unit 82 randomly selects a plurality of player symbols 76 from the predefined set of bingo symbols 78 and displays the selected player symbols 76 on the bingo card 74. In the illustrated embodiment, the bingo symbol selection unit 82 displays at least one bingo card 74 with a plurality of symbol positions 90 being displayed in a grid 92 and arranged along a plurality of rows 94 and a plurality of columns 96. Each selected player symbol 76 is displayed in a corresponding symbol position 90. In the illustrated embodiment, the bingo card 74 displays a total of 20 symbol positions 90 displayed within the grid 92 arranged in 5 rows 94 and 4 columns 96 in a "5×4" arrangement. Alternatively, any number of symbol positions 90 may be displayed in any suitable grid arrangement including, for example, 25 symbol positions 90 displayed in a 5×5 arrangement, 9 symbol positions 90 displayed in a 3×3 arrangement, and/or any suitable number of symbol positions 90 displayed in any suitable row 94 and column 96 combination to enable the gaming controller 34 to function as described herein. In addition, the grid 92 may be displayed with a plurality of shapes such as, for example, a rectangle, a square, a diamond, a circle, and/or any suitable shape that enables the gaming controller 34 to function as described herein.

In method step 208, the secondary symbol selection unit 80 selects a plurality of card symbols 84 from the predefined set of card symbols 84, and assigns each card symbol 84 to a corresponding symbol position 90. In one embodiment, the secondary symbol selection unit 80 may also randomly assign each selected card symbol 84 to a corresponding symbol position 90 such that each symbol position 90 is assigned a unique card symbol 84. For example, as shown in FIG. 6, in one embodiment, the game module 64 may display a bingo card 74 including 20 symbol positions 90 being arranged in 4 columns 96. The game module 64 may randomly select a plurality of card symbols 84 and assign each card symbol 84 to a corresponding symbol position 90. In one embodiment, the game module 64 may select each card symbol 84 such that each card symbol 84 being associated with a column 96 includes a similar card characteristic. For example, in one embodiment, the game module 64 may display the bingo-type game 70 including a $1^{st}$ column 98, a $2^{nd}$ column 100, a $3^{rd}$ column 102, and a $4^{th}$ column 104. The game module 64 may select a plurality of card symbols 84 from a predefined set of card symbols 84 having a predefined set of card characteristics such as, for example, a card suit including suits of spades, diamonds, clubs, and hearts. The game module 64 may assign each column 96 to a suit of cards, and assign each selected card symbol 84 to a corresponding symbol position 90 such that each card symbol 84 associated with a column 96 is included in the same card suit. As shown in FIG. 6, in one embodiment, the game module 64 may randomly select a plurality of card symbols 84 associated with the $1^{st}$ column 98 such that each selected card symbol 84 is included in a suit of spades. Similarly, the game module 64 may randomly select a plurality of card symbols 84 associated with the $2^{nd}$, $3^{rd}$, and $4^{th}$ columns 100, 102, and 104, such that the $2^{nd}$ column 100 includes card symbols 84 from a suit of diamonds, the $3^{rd}$ column 102 includes card symbols 84 from a suit of clubs, and the $4^{th}$ column 104 includes card symbols 84 from a suit of hearts. In addition, the game module 64 may display a card suit symbol 106 associated with each column 96 to indicate to the player that each card symbol 84 arranged in the respective column 96 is included in the corresponding card suit.

In one embodiment, the game module 64 may also select a predefined set of card symbols 84 from each card suit and randomly assign the card symbols 84 to each column 96. For example, as shown in FIG. 6, for the $1^{st}$ column 98, the game module 64 may select a predefined set of card symbols 84 from the suit of spades, and randomly assign each selected card symbol 84 to a symbol position 90 within the $1^{st}$ column 98. In addition, the predefined set of card symbols 84 may be limited to a predefined amount of cards having a predefined value. For example, in one embodiment, as shown in FIG. 6, the predefined set of card symbols 84 may include card symbols 84 associated with the "Queen", "Jack", "10", "9", and "8" cards in each card suit including "spades", "diamonds", "clubs", and "hearts". The game module 64 may randomly assign each of the card symbols 84 to symbol positions 90 corresponding to a card suit such that the $1^{st}$, $2^{nd}$, $3^{rd}$, and $4^{th}$ columns 98, 100, 102, and 104 each include the "Queen", "Jack", "10", "9", and "8" cards in a corresponding suit. Moreover, the game module 64 may randomly assign a symbol position 90 associated with each card symbol 84. In one embodiment, the predefined set of card symbols 84 may include one or more special card symbols 107 (represented by the "Joker" card shown in FIG. 5) that may be substituted for any card symbol 84 included in a winning combination. The game module 64 may randomly select a special card symbol 107 from the set of card symbols 84 and randomly assign the special card symbol 107 to one or more symbol positions 90.

In one embodiment, the game module 64 may also select a plurality of card symbols 84 such that each column 96 includes card symbols 84 each having the same color. For example, as shown in FIG. 6, the game module 64 may select card symbols 84 such that the $1^{st}$ and $3^{rd}$ columns 98 and 102 each include card symbols 84 having a red color. Similarly, the game module 64 may select card symbols 84 such that the $2^{nd}$ and $4^{th}$ columns 100 and 104 include card symbols 84 having a black color.

As shown in FIGS. 5 and 7, in the illustrated embodiment, the game module 64 randomly selects a card symbol 84 associated with each symbol position 90 and randomly selects a plurality of player symbols 76 and displays the selected player symbols 76 with each symbol position 90. In one embodiment the game module 64 displays the bingo card 74 such that the card symbols 84 are not initially visible to the player, and are only revealed to the player when a selected bingo symbol 78 matches a corresponding player symbol 76. In another embodiment, the game module 64 may display the bingo card 74 such that the card symbol 84 and the player symbol 76 are each visible to the player during play of the bingo-type game 70. In one embodiment, the game module 64 may also reveal and/or display the card symbol 84 when the player selects (e.g. mark or daub via a corresponding user selection areas 72) a corresponding player symbol 76 and/or the game module determines the daubed player symbol 76 is a matched symbol. In another embodiment, the game module 64 may randomly select a card symbol 84 associated with a selected player symbol 76 after the player has daubed the corresponding player symbol 76. In addition, the game module 64 may determine a symbol position 90 associated with the daubed player symbol 76, determine the predefined set of card symbols 84 associated with the identified symbol position 90, and randomly select a card symbol 84 from the predefined set of card symbols 84, and assign the selected card symbol 84 to the marked symbol position 90.

In method step 210, the game module 64 randomly selects a plurality of bingo symbols 78 from the predefined set of bingo symbols 78 and displays each selected bingo symbol 78 in the game screen 88.

In method step 212, the game module 64 determines if each of the selected bingo symbols 78 matches a corresponding player symbol 76 displayed on the bingo card 74 and determines an outcome of the bingo-type game 70 as a function of the matched player symbols 76. In the illustrated embodiment, the game module 64 plays the bingo-type game 70 in a conventional manner. The player makes a wager, which may be based on a predetermined denomination and a selected number of bingo cards 74 to be selected by the player and/or a selected number of bingo symbols 78, and initiates a symbol draw operation. During the symbol draw operation, the game module 64 randomly selects a plurality of bingo symbols 78 from the predefined set of bingo symbols 78 and sequentially displays each selected bingo symbol 78 on the display device 30. In one embodiment, the game module 64 may compare the player symbols 76 displayed on each selected bingo card 74 with each drawn bingo symbol 78, and identify each player symbol 76 that matches the drawn bingo symbol 78. In another embodiment, the player may identify the matched player symbol 76 by transmitting a user selection input via a selection area 72 corresponding to the selected player symbol 76.

In method step 214, the game module 64 identifies each card symbol 84 associated with each matched player symbol 76. For example, in the illustrated embodiment, the game module 64 randomly selects a bingo symbol 78 and determines if the selected bingo symbol 78 matches a player symbol 76 being displayed in bingo card 74. The game module 64 determines the symbol position 90 being displayed with the matched player symbol 76 and identifies the card symbol 84 associated with the determined symbol position 90.

In method step 216, the game module 64 determines a combination formed by each of the identified card symbols 84 and determines an outcome of the game 70 based on the formed combination.

In method step 218, the game module 64 provides the player an award if the determined combination of identified card symbols 84 forms a winning combination of card symbols 84. The game module 64 may provide an award to the player based on the combination of identified card symbols 84, the wager, and a predetermined paytable. In general, the term "award" may be a payout, in terms of credits or money. Thus, the gaming controller 34 may award a regular payout in response to the outcome of the bingo-type game 70. However, it should be noted that the term award may also refer to other types of awards, including prizes, e.g., meals, show tickets, etc. . . . , as well as in-game awards, such as free games, bonus symbols, and/or special game modes.

In one embodiment, the award module 66 may define the winning combination as including a predefined sequence of card symbols 84. For example, in one embodiment, the award module 66 may define the winning combination as a function of game rules associated with card-type games including, but not limited to, poker, poker-based games, blackjack, solitaire, solitaire-based games, hearts, war, baccarat, gin-rummy, bridge, spades, matching-type games, and/or any suitable card-based game. The game module 64 may provide an award if the combination formed by the identified card symbols 84 matches the predefined sequence. In another embodiment, the game module 64 may randomly select the winning combination from a predefined set of card symbols 84. In one embodiment, for example, the winning combination may be defined as including a solitaire-type card sequence in which card symbols 84 are ordered in descending value beginning with a "King" card, and with alternative card colors in the combination. In one embodiment, each card symbol 84 may include an associated card value such as, for example, a "King" having a higher value than a "Queen", a "Jack" having a lower value than a "Queen", and each face-card (e.g. "King", "Queen", and "Jack" cards) having a higher value that a number-card (e.g. "10", "9", and "8" cards), and each number-card having a value relative to the associated card number. The game module 64 may define the winning combination including a predefined sequence of card values. For example, in one embodiment, the game module 64 may define the winning combination including a "King", "Queen", "Jack", "10", "9" and "8" cards. In addition, the game module 64 may define the winning combination as including a predefined sequence of card colors. For example, in one embodiment, the game module 64 may define the winning combination including each card symbol 84 ordered in descending value and having alternative card colors such that the winning combination includes a red "King", a black "Queen", a red "Jack", a black "10", a red "9", and a black "8". In another embodiment, the winning combination may be defined as including card symbols 84 having the same suit, having the same color, having different suits, having different colors, having the same card value, having different card values, and/or having any suitable combination of card characteristics.

In one embodiment, the game module 64 may randomly select a predefined amount of bingo symbols 78, determine the matched player symbols from the selected bingo symbols, and identify each card symbol 84 associated with each matched player symbol 76. The game module 64 may also provide an award to a player if the player obtains a matched card symbol 84 having a value that is equal to, or greater than, a predefined value. In addition, in one embodiment, the game module 64 may allow a plurality of players to play the game 70, with each player being assigned one or more bingo cards 74. The game module 64 may randomly select a predefined amount of bingo symbols 78 during a bingo draw, and identify the card symbols 84 associated with each matched player symbol 76 for each bingo card 74. The game module 64 may also determine a value associate with each identified card symbol 84 and provide an award to the player that obtained the highest valued card symbol 84 during the bingo draw. In another embodiment, the game module 64 may conduct the bingo draw over a predefined period of time, and provide an award to the player having the highest value matched card symbol 84 at the end of the time period.

In the illustrated embodiment, the game module 64 determines if the identified card symbol 84 is included in a winning combination, and responsively displays the associated card symbol 84 in a card symbol area 108 being displayed in the game screen 88 and separate from the grid 92 to notify the player of a potential winning combination. In one embodiment, the game module 64 displays each identified card symbol 84 in the associated symbol position 90, and subsequently moves the identified card symbol 84 from the corresponding symbol position 90 to the card symbol area 108 if the identified card symbol 84 is included in a winning combination. In another embodiment, the game module 64 may retain an identified card symbol 84 in the corresponding symbol position 90 until a complete winning combination, including each identified card symbol 84, is identified in the bingo card 74. In a further embodiment, the game module 64 may retain an identified card symbol 84 in the corresponding symbol position 90 until each card symbol 84 that occurs earlier in the winning combination sequence is identified and displayed in the card symbol area 108.

For example, during game play, in one embodiment, a winning combination may include a red "Queen", a black "Jack", a red "10", a black "9", and a red "8". If the game module 64 identifies a red "10" based on a matched player symbol 76 associated with the symbol position 90 associated with the red "10", the game module 64 may display the red "10" in the corresponding symbol position 90, and retain the red "10" in the symbol position until the red "Queen" and black "Jack" are similarly identified. In addition, if a black "Jack" is subsequently identified, the game module 64 retains the black "Jack" and the red "10" in the respective symbol positions 90 until a red "Queen" is identified. Upon identifying a red "Queen" based on a matched player symbol 76, the game module 64 moves the red "Queen", the black "Jack", and the red "10" to the card symbol area 108, and displays each card symbol 84 in an order determined as a function of the winning combination.

In one embodiment, the game module 64 may define a winning combination including a first card symbol 84 and a second card symbol 84. The game module 64 may randomly select the first card symbol 84 from a predefined set of card symbols 84 with the first card symbol 84 having a first characteristic. The game module 64 may also define the winning combination including the second card symbol 84 having a second characteristic that is different than the first card characteristic. For example, as shown in FIG. 5, the game module 64 may define the winning combination as including a sequence of card values including a "King", a "Queen", a "Jack", a "10", a "9", and a "8" card. The game module 64 may randomly select a "King" card symbol from a predefined set of card symbols 84 that includes each "King" card from each suit, e.g. spades, diamonds, clubs, and hearts, and define the winning combination as a function of the randomly selected card symbol 84. For example, in one embodiment, the game module 64 may randomly select the first card symbol 84 including the red "King" of hearts, and define the winning combination to include a second card symbol 84 including a black "Queen", having a different card color than the randomly selected red "King" card. In addition, the game module 64 may randomly select the winning combination to include a predefined sequence of card symbols 84 as a function of the randomly selected first card symbol 84. For example, the game module 64 may randomly select the first card symbol 84 including a black "King" and define the winning combination that includes a predefined sequence of cards symbols including the black "King", a red "Queen", a black "Jack", a red "10", a black "9", and a red "8" card.

In one embodiment, the game module 64 may randomly select a winning combination of card symbols 84 from a predefined set of card symbols 84, and randomly assign each card symbol 84 included in the predefined set of card symbols 84 to each of the symbol positions 90 being displayed with the bingo card 74. In this manner, each bingo card 74 being generated by the game module 64 includes each card symbol 84 included in the winning combination. For example, the game module 64 may randomly select a winning combination including a red "King", a black "Queen", and a red "Jack" card. The game module 64 may generate a bingo card 74 that includes the "King", "Queen", and "Jack" card from each card suit such that the generated bingo card 74 includes each card symbol 84 included in the randomly selected winning combination.

In one embodiment, the game module 64 may determine a number of players to be included in a round of the bingo-type game 70 and determine a number of awards that are available during the round based on the number of player's participating in the game round. For example, the game module 64 may determine a predefined number of players required to play a round of the game and/or a predefined number of bingo cards to be included in a game round. The game module 64 may also initiate game play when the number of requests to play the game and/or the number of bingo cards issued is equal to the predefined number of player's and/or the predefined number of bingo cards, respectively. In addition, the game module 64 may also determine a number of awards based on the number of players participating in the game round and/or the number of bingo cards issued during the game round. During play of the game, the game module 64 may determine the outcome of each bingo card 74 and terminate the game round when the determined number of awards has been awarded during the round.

In one embodiment, the game module 64 may also require each player to select (e.g. mark or daub via user selection areas) the matched player symbols 76 during play of the game and require the player to indicate that the corresponding bingo card 74 includes a winning outcome by selecting a "BINGO!" selection area 72 displayed with each bingo card 74. In another embodiment, during game play, the game module 64 may also determine if a bingo card 74 includes a winning outcome and prompt the player to select the "BINGO!" selection area 72 before providing an award to the player. In this manner, the gaming controller 34 may provide an award to the player only if the player selects the "BINGO!" selection area 72 and the corresponding bingo card 74 includes a winning outcome. In one embodiment, during a round of a game, the game module 64 may determine that the number of players having winning outcomes, for example winning bingo cards, is greater than the number of awards to be provided during the round. The game module 64 may determine which players may receive an award by detecting a number of players who indicate a winning outcome prior to the next drawn bingo symbol 78 being displayed, and provide an award to each player that has indicated a winning outcome before the next bingo symbol 78 is drawn. In addition, the game module 64 may detect a period of time from the display of the previously drawn bingo symbol 78 at which each player has indicated a winning outcome prior to the draw of the next bingo symbol 78, and provide the awards to the players in chronological order based on the time at which each player indicated a winning outcome. The player may indicate a winning outcome by selecting the "BINGO!" selection area 72 upon achieving a winning bingo card outcome. Many variations to the above described general play of a bingo-type game fall within the scope of the present invention.

In method step 220, the game module 64 allows the player to play a plurality of bingo-type games and, for each game, determines if each identified card symbol 84 is associated with a predefined collection of card symbols. The game module 64 calculates a total amount of identified card symbols 84 associated with the predefined collection of card symbols and provides the player another award if the total amount of identified card symbols 84 is equal to a predefined amount of card symbols. Moreover, the game module 64 stores each identified card symbol 84 obtained by a player in the associated user profile account contained in the database 42 and provides an award to the player if the amount of collected card symbols is equal to a predefined amount. In addition, the game module 64 may be configured to display a collections screen 86, as shown in FIG. 8, including each collection 110 of card symbols 84 being eligible for an award, and an amount of card symbols 84 obtained by the player corresponding to each eligible collection 110. Each card collection includes one or more card symbols 84 having a predefined card characteristic. For example, in one embodiment, the game module 64 may determine an amount of "10" cards collected by the player over a predetermined number of bingo-type games 70 being played by the player, and provide an award to the player if the determined amount of "10" cards is equal to a predetermined amount.

Figure 9:
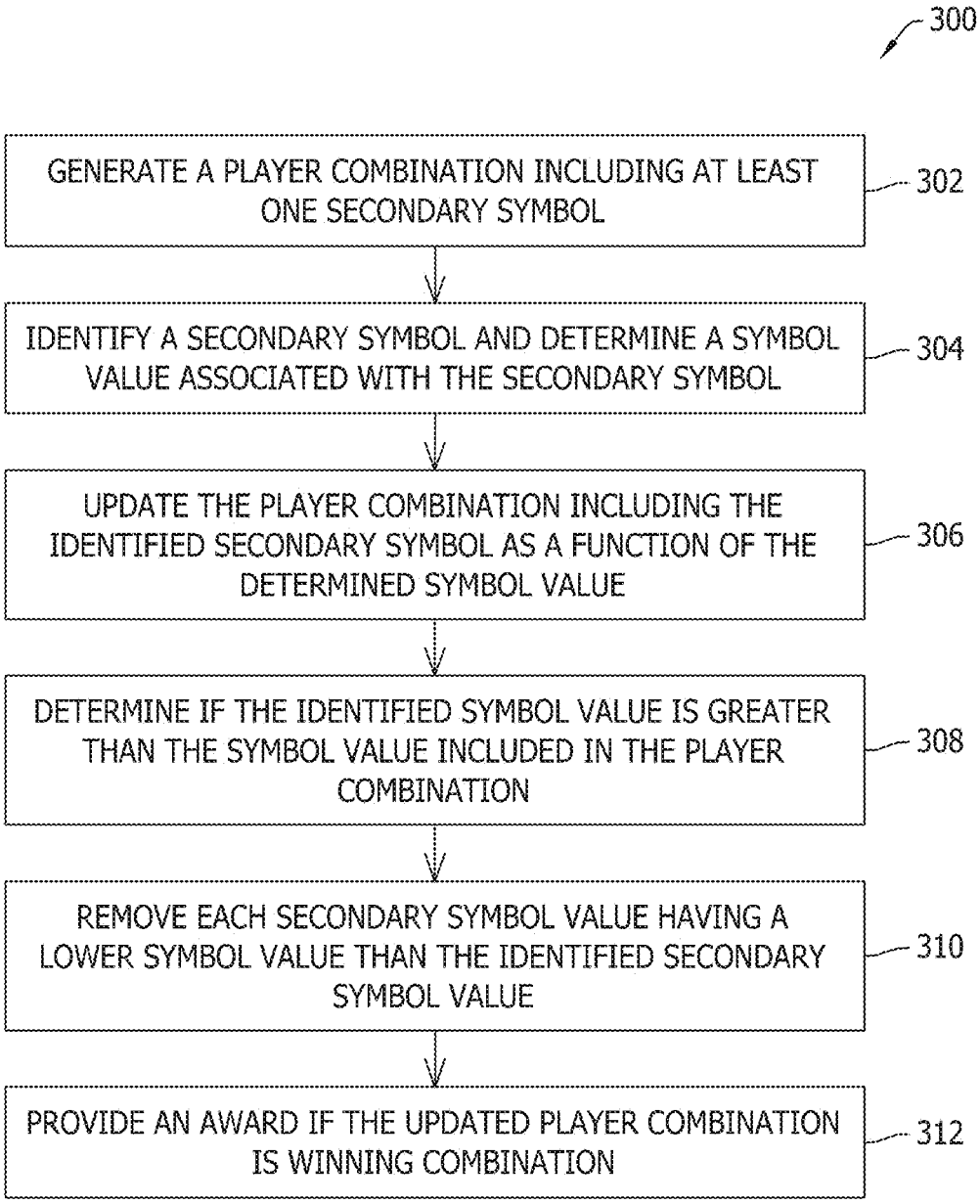
FIG. 9 is another flowchart of a method that may be used with the system shown in FIG. 1 for allowing a player to play a game via a user computing device, according to an embodiment of the invention.
Figure 10:
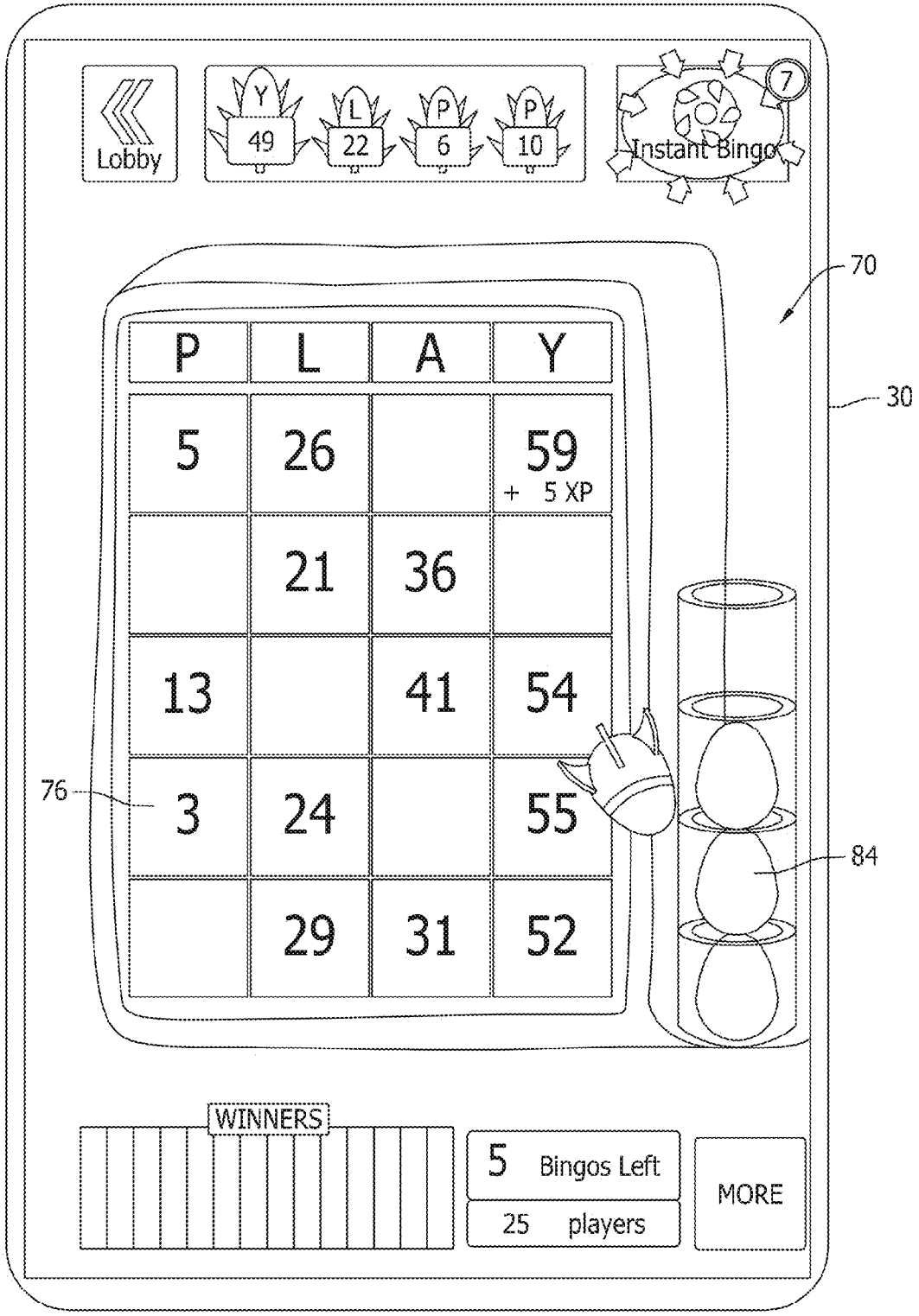
FIG. 10 is an exemplary entertaining graphical display of a bingo-type game that may be used with the methods shown in FIGS. 3 and 9, according to an embodiment of the present invention.
Figure 11:
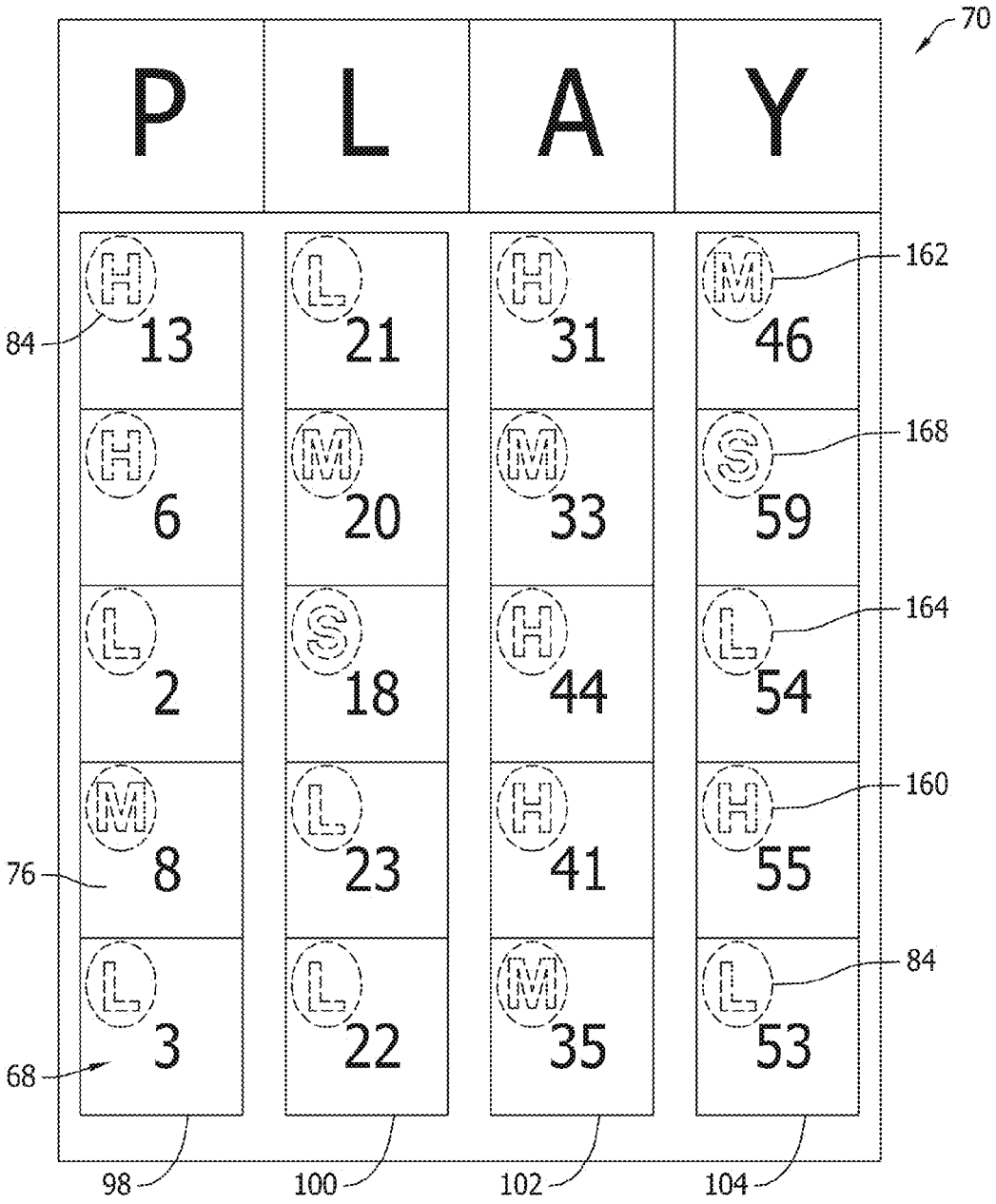
FIG. 11 is another exemplary entertaining graphical display of a bingo-type game that may be used with the methods shown in FIGS. 3 and 9, according to an embodiment of the present invention.
Figure 12:
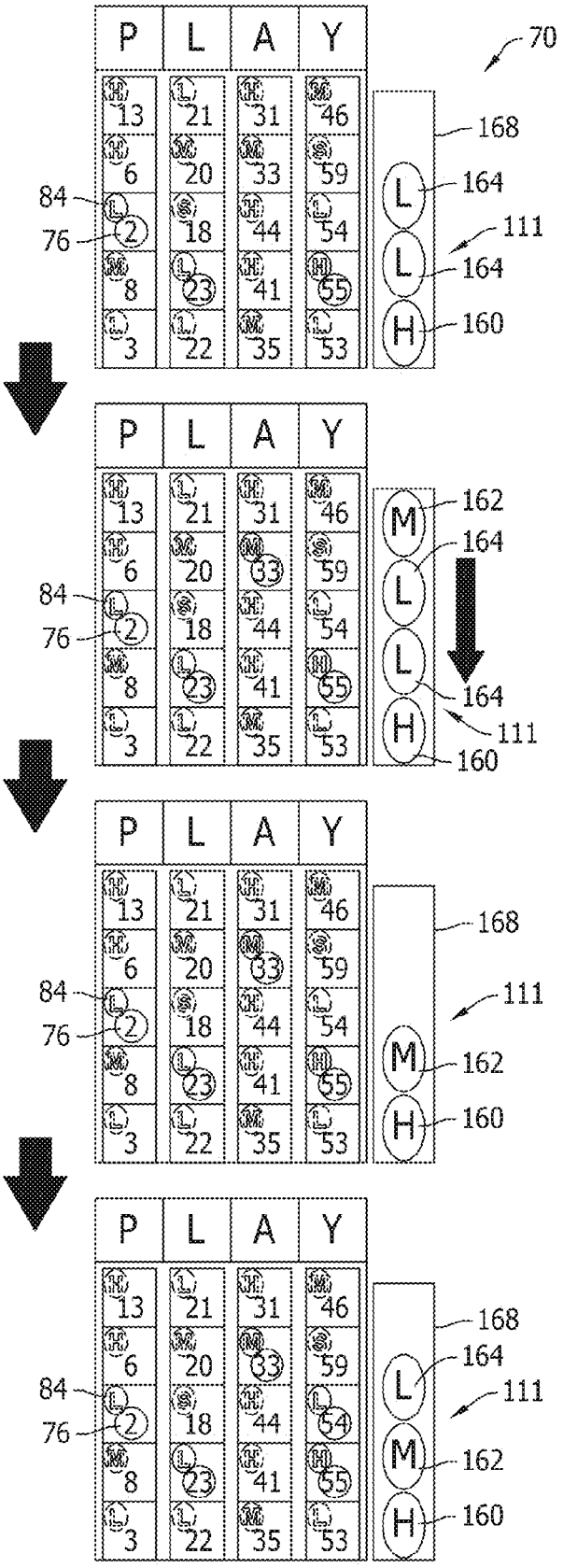
FIG. 12 is series of graphical displays of the bingo-type game shown in FIG. 10 that may be used with the methods shown in FIGS. 3 and 9.

FIG. 9 is another flowchart of a method 300 that may be used with the system 10, according to an embodiment of the invention. Each method step may be performed independently of, or in combination with, other method steps. Portions of the method 300 may be performed by any one of, or any combination of, the components of the system 10. FIGS. 10 and 11 are entertaining graphical displays of the bingo-type game 70 that may be used with methods 200 and 300. FIG. 12 is series of graphical displays of the bingo-type game 70 shown in FIGS. 10 and 11. In the illustrated embodiment, the gaming controller 34 is configured to generate a player combination 111 as a function of each identified secondary symbol 84 and provide the player an award if the player combination 111 includes a winning combination. In addition, the gaming controller 34 may also update the player combination 111 as a function of each subsequently matched secondary symbol 84. For example, in one embodiment, the game module 64 may select the secondary symbols 84 from a predefined set of secondary symbols 84, with each secondary symbol 84 having a predefined symbol value. The game module 64 may also define a winning combination as including a predefined amount of secondary symbols 84 being arranged in a predefined sequence based on the symbol values. In addition, the game module 64 may also define a plurality of winning combinations that each include the predefined amount of secondary symbols 84 being arranged in different sequential orders. For example, in one embodiment, each secondary symbol 84 may have a predefined symbol value selected from a predefined group of symbol values such as, for example, a symbol value group including a high "H" value, a medium "M" value, and a low "L" value. The game module 64 may define a set of winning combinations that includes winning combinations having a predefined value sequence that includes each subsequent secondary symbol having a value that is less than, or equal to, the value of the preceding symbol. For example, in one embodiment, the set of winning combinations may include four secondary symbols 84 being arranged in one of the following fifteen sequences: HHHH, HHHM, HHHL, HHMM, HHML, HHLL, HMMM, HMML, HMLL, HLLL, MMMM, MMML, MMLL, MLLL, and LLLL. In another embodiment, the predefined sequence may include each subsequent symbol having a value that is greater than, or equal to, the value of the preceding symbol and/or any suitable combination of symbol values and/or symbol characteristics. The game module 64 may determine if the player combination 111 matches one of the predefined winning combinations and responsively provide an award to the player if the player combination 111 includes one of the predefined sequences.

In one embodiment, the game module 64 may randomly select a plurality of secondary symbols 84 from a predefined set of secondary symbols 84 including a first symbol having a first symbol value, i.e. a high value symbol 160, a second symbol having a second symbol value, i.e. a medium value symbol 162, and a third symbol having a third symbol value, i.e. a low value symbol 164. During the symbol draw, the game module 64 may generate the player combination 111 as a function each matched secondary symbol 84 marked by the player (represented as a "circle" shown in FIG. 12) and display the player combination 111 in a player combination area 166 being displayed in the game screen 88. In addition, as each secondary symbol 84 is identified, the game module 64 may update the player combination 111 as a function of the value of the currently identified secondary symbol 84 and may remove and/or modify one or more symbols included in the player combination 111 based on the value of the currently matched secondary symbol 84.

In the illustrated embodiment, in method step 302, the game module 64 generates a player combination 111 including at least one secondary symbol 84. In method step 304, the game module 64 may identify another secondary symbol 84 as a function of a matched player symbol 76 and determine a symbol value associated with the identified secondary symbol 84. In method step 306, the game module 64 updates the second player combination 111 to include the identified secondary symbol 84 as a function of the determined symbol value of the identified secondary symbol 84. For example, as shown in FIG. 12, in one embodiment, during play of the game 70, the game module 64 may identify a secondary symbol 84 and generate a player combination 111 as a function of the identified secondary symbol 84. During game play, the game module 64 may subsequently identify another secondary symbol 84 associated with a matched player symbol 76, determine the value of the secondary symbol 84, and update the player combination 111 as a function of the identified secondary symbol value.

In method step 308, the game module 64 may also determine if the identified symbol value is greater than the symbol value associated with each secondary symbol 84 included in the current player combination 111. In method step 310, the game module 64 may also responsively remove each secondary symbol 84 having a lower symbol value than the identified secondary symbol 84 from the current player combination 111. For example, in one embodiment, the game module 64 may determine if the currently identified symbol value is greater than each of the subsequent symbol values in the player combination 111, remove each secondary symbol 84 having a symbol value that is less than the currently identified symbol value, and generate an updated player combination 111.

In method step 312, for each subsequent symbol draw, the game module updates the player combination 111 based on the value of the currently identified secondary symbol 84, and provides an award to the player if the updated player combination 111 includes a winning combination sequence. For example, in one embodiment, as shown in FIG. 12, during game play, the game module 64 may generate a player combination 111 that includes a sequence having a high value symbol 160, a low value symbol 164, and a low value symbol 164, with a symbol value sequence of high, low, low symbol values (shown as "HLL"), and display the player combination 111 in the player combination area 166. During the subsequent symbol draw, if the game module 64 identifies a medium value symbol 162, the game module 64 generates an updated player combination 111 by removing each secondary symbol 84 having a symbol value that is less than the identified medium value symbol 162. More specifically, in the illustrated embodiment, the game module 64 removes the low value symbols 164 from the player combination sequence and generates the updated player combination 111 including the high value symbol 160 and the medium value symbol 162. In another subsequent symbol draw, if the game module 64 identifies a secondary symbol 84 having a value less than, or equal to the previous symbol value, the game module 64 will update the player combination 111 to include the currently identified secondary symbol 84 and each previous secondary symbol 84 in preceding player combination 111. For example, as shown in FIG. 11, during a subsequent symbol draw, the game module 64 may identify a low value symbol 164 and update the player combination 111 to add the low value symbol 164 to the player combination 111 because the low value symbol 164 has a symbol value that is less than the values of the preceding symbols.

In one embodiment, the set of secondary symbols 84 may also include one or more special symbols 168. Upon selection of the special symbol 168, the game module 64 may remove at least one symbol from the player combination 111 as a penalty for selecting the special symbol 168. For example, in one embodiment, upon selecting the special symbol 168, the game module 64 may remove the first secondary symbol 84 positioned in the first position in the sequence of symbols in the player combination 111.

Figure 13:
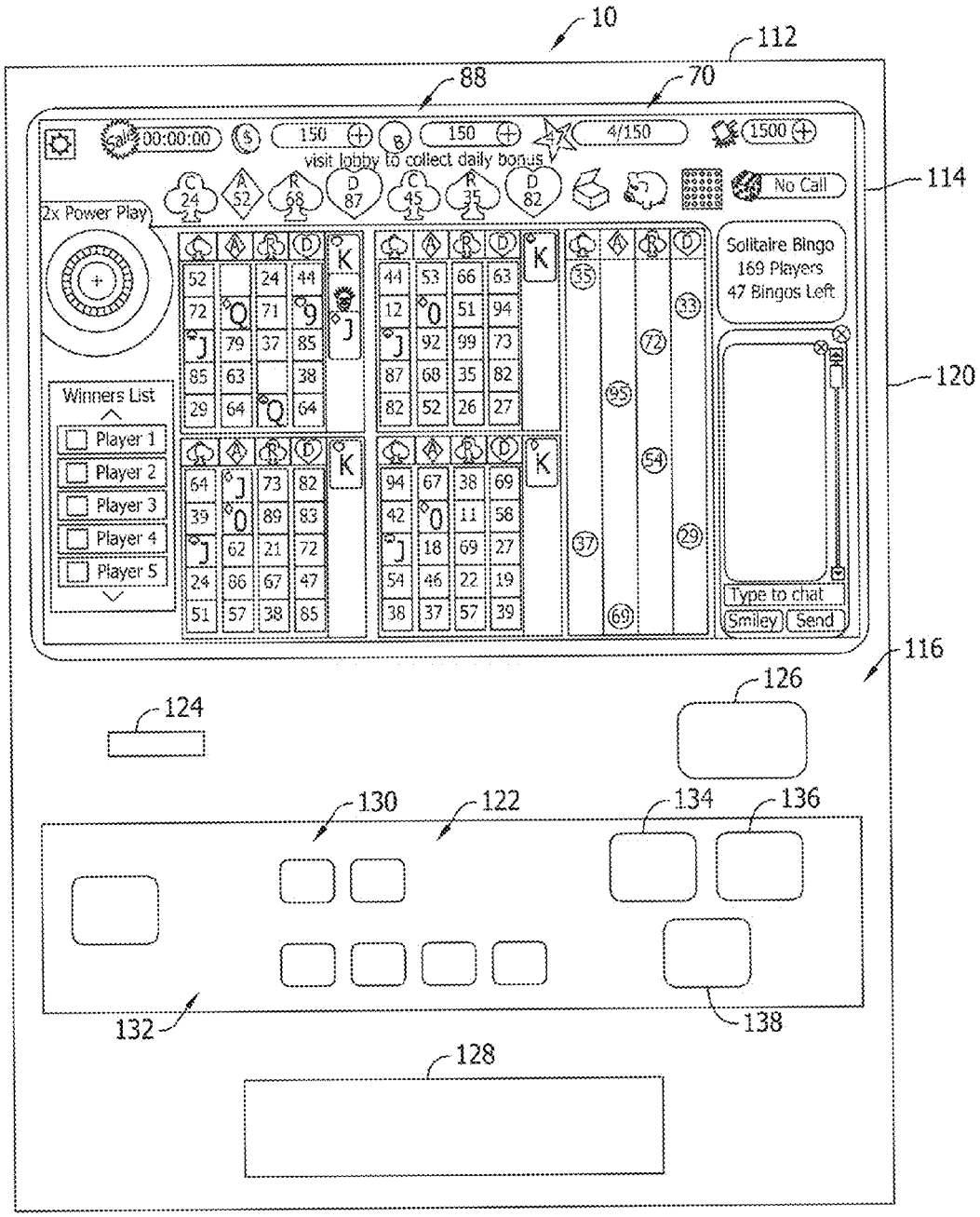
FIG. 13 is a schematic representation of a gaming machine for allowing a player to play a bingo-type game, according to an embodiment of the invention.
Figure 14:
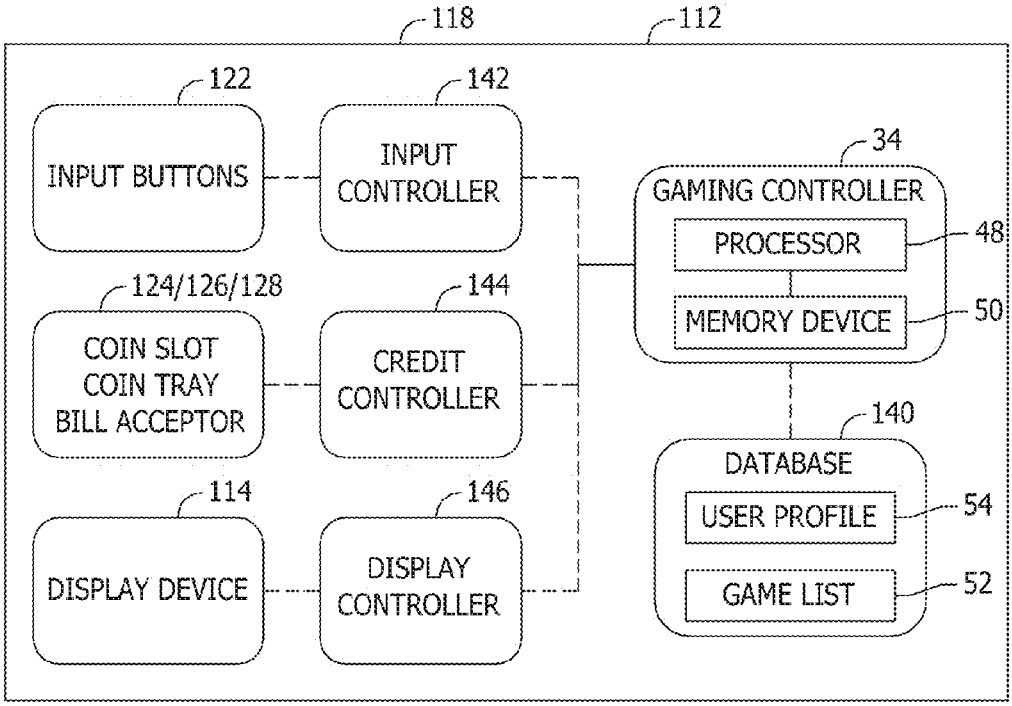
FIG. 14 is another schematic view of the gaming machine shown in FIG. 13.

FIG. 13 is a schematic representation of a gaming machine 112 that may be used with the system 10 to allow a player to play the bingo-type game 70, according to an embodiment of the present invention. FIG. 14 is another schematic view of the gaming machine 112. A preferred embodiment of the present invention is a video gaming machine preferably installed in a casino. In the illustrated embodiment, the gaming machine 112 includes a display device 114 such as, for example a display device 30 for displaying a plurality of games, a user input device 116 to enable a player to interface with the gaming machine 112, and a system controller 118 that is operatively coupled to the display device 114 and the user input device 116 to enable a player to play games displayed on the display device 114. The gaming machine 112 may also include a cabinet assembly 120 that is configured to support the display device 114, the user input device 116, and/or the system controller 118 from a supporting surface.

The display device 114 and the user input device 116 are coupled to the cabinet assembly 120 and are accessible by the player. In one embodiment, the system controller 118 is positioned within the cabinet assembly 120. Alternatively, the system controller 118 may be separated from the cabinet assembly 120, and connected to components of the gaming machine 112 through a network such as, for example, a local area network (LAN), a wide area network (WAN), dial-in-connections, cable modems, wireless modems, and/or special high-speed Integrated Services Digital Network (ISDN) lines.

In the illustrated embodiment, the display device 114 displays the game screen 88 (shown in FIGS. 4 and 5) including indicia and/or symbols for use in a game, e.g., symbols for a bingo game, cards used by a card game, roulette wheel and symbols used in a roulette game, and/or reels used in a reel game.

The user input device 116 includes a plurality of input buttons 122, a coin slot 124, a bill acceptor 126, and a coin tray 128 for dispensing coins to the player. In one embodiment, the input buttons 122 may include a plurality of BET switches 130 for inputting a wager on a game and selecting a number of rounds to be played during a gaming session, a plurality of selection switches 132 for allowing a player to select a plurality of game symbols, a CLEAR switch 134 for de-selecting player selected game symbols, a PAYOUT switch 136 for ending a gaming session and dispensing accumulated gaming credits to the player, and a start button, i.e., a DRAW switch 138 to initiate an output of a game. In addition, the user input device 116 may include, for example, a keyboard, a pointing device, a mouse, a stylus, a touch sensitive panel (e.g., a touch pad or a touch screen), a gyroscope, an accelerometer, a position detector, an audio input device, and/or any suitable input device that enables the player to interact with the gaming machine 112.

The coin slot 124 includes an opening that is configured to receive coins and/or tokens deposited by the player into the gaming machine 112. The gaming machine 112 converts a value of the coins and/or tokens to a corresponding amount of gaming credits that are used by the player to wager on games played on the gaming machine 112. The bill acceptor 126 includes an input and output device that is configured to accept a bill, a ticket, and/or a cash card into the gaming machine 112 to enable an amount of gaming credits associated with a monetary value of the bills, ticket, and/or cash card to be credited to the gaming machine 112.

Referring to FIG. 14, in the illustrated embodiment, the system controller 118 includes the gaming controller 34, a database 140, an input controller 142, a credit controller 144, and a display controller 146. The gaming controller 34 communicates to the database 140, the input controller 142, the credit controller 144, and the display controller 146, and executes various programs, and thereby controls other components of the gaming machine 112 according to player instructions and data accepted by the user input device 116. The gaming controller 34 in particular executes a game program to implement the method 200 and thereby conducts a game in accordance with the embodiments described herein. In one embodiment, the gaming controller 34 utilizes RAM to temporarily store programs and data necessary for the progress of the game, and EPROM to store, in advance, programs and data for controlling basic operation of the gaming machine 112, such as the booting operation thereof.

The credit controller 144 manages the amount of player's credits, which is equivalent to the amount of coins and bills counted and validated by the bill acceptor 126. The credit controller 144 converts a player's credits to coins, bills, or other monetary data by using the coin tray 128 and/or for use in dispensing a credit voucher via the bill acceptor 126.

The input controller 142 is coupled to the user input device 116 to monitor player selections received through the input buttons 122, and accept various instructions and data that a player enters through the input buttons 122.

The display controller 146 controls the display device 114 to display various images on screens preferably by using computer graphics and image data stored in the database 140. More specifically, the display module 56 controls the game symbols displayed in the game such as, for example, a bingo-type game 70 displayed on the display device 114 by using computer graphics and the image data.

Figure 15:
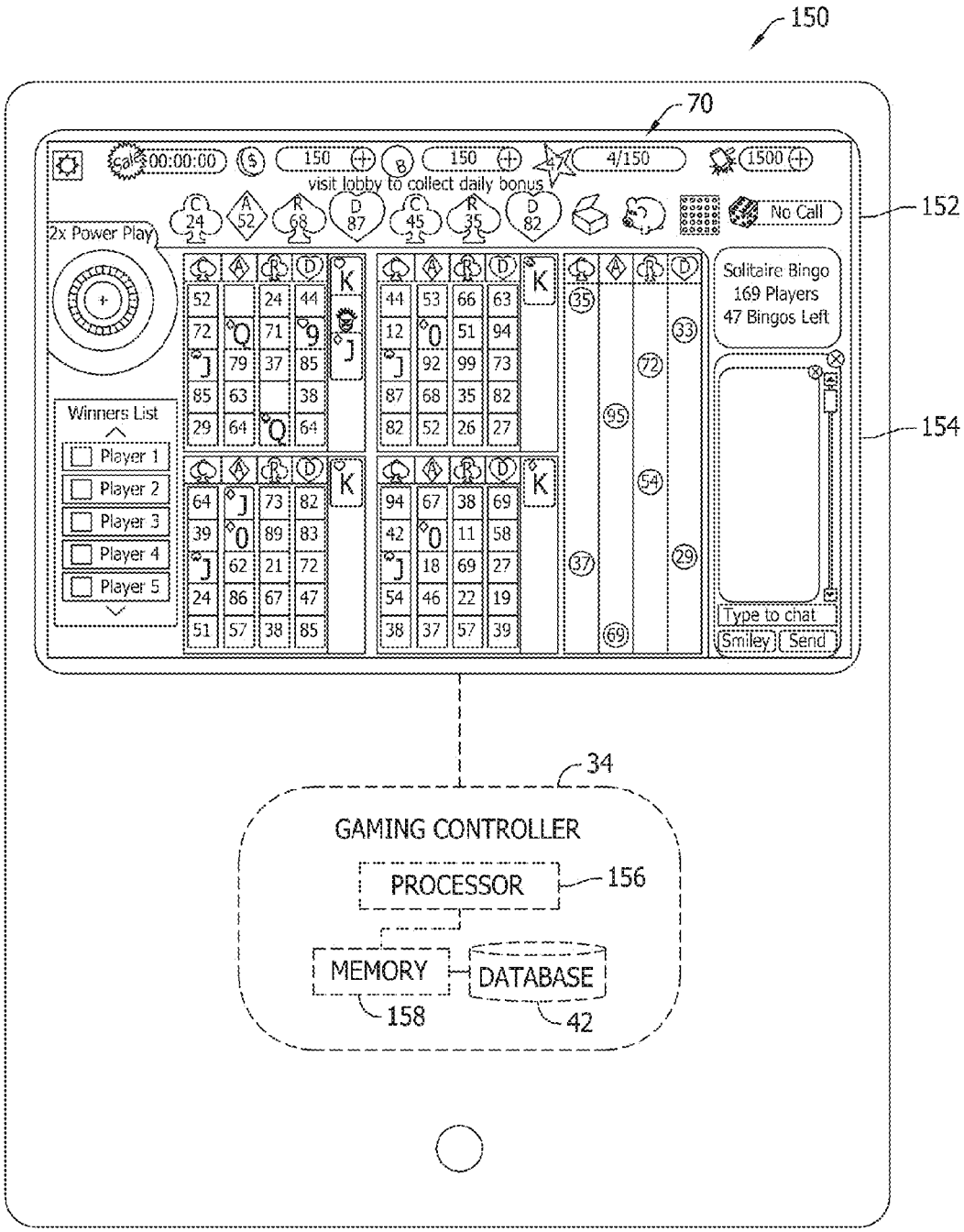
FIG. 15 is a schematic view of a gaming device for allowing a player to play a bingo-type game, according to an embodiment of the invention.

FIG. 15 is a schematic view of a gaming device 150 for allowing a player to play the bingo-type game 70, according to an embodiment of the invention. The gaming device 150 may be a smartphone, a personal computer, laptop, cell phone, tablet computer, smartphone/tablet computer hybrid, personal data assistant, smart watch, and/or any suitable computing device that displays the graphical interfaces 16 and enables the user to play the bingo-type game 70. In the illustrated embodiment, the gaming device 150 includes a display device 152 such as, for example, display device 30, a user input device 154 such as, for example, user input device 32, and the gaming controller 34 coupled to the display device 152 and the user input device 154.

The gaming controller 34 includes database 42, the processor 156 and the memory device 158 that is coupled to the processor 156. The memory device 158 stores programs and information used by the processor 156 including, but not limited to, image data for producing images and/or screens on the display device 152, game indicia, symbol weights, paytables, and/or winning combination tables which represent relationships between combinations of random numbers, combinations of symbol matches and types of awards associated with the bingo-type game 70.

The processor 156 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the gaming controller 34 to store, retrieve, and/or execute instructions and/or data. The gaming controller 34 in particular executes a game program to implement the method 200 and thereby conducts a game in accordance with the embodiments described herein.

The above-described systems and methods overcome at least some disadvantages of known systems by allowing a player to play a bingo-type game that includes card symbols, matching player symbols, identifying card symbols associated with the matched player symbols, and determining winning game outcomes based on the combination of identified card symbols. Moreover, the systems and methods are configured to allow a player to play a solitaire-type game within the bingo-type game by defining the winning combinations a including a solitaire-type order of card symbols including a descending value of card symbols with alternative card colors. By providing an award to the player based on the combination of card symbols associated with each matched player symbol, the player's expectation of achieving a winning outcome with the purchased bingo card is increased, thus increasing the amount of bingo cards purchased by the player and increasing the amount of revenue received from the purchases.

Exemplary embodiments of a system and method of allowing a player to play a bingo-type game via a mobile computing device are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other wagering applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as, for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A computer-implemented method of providing a card game integrated with a bingo game, comprising:

validating, by a validation device, one or more physical objects received from a player;

determining a count of gaming credits available to the user, the count of gaming credits based on a value of the one or more validated physical objects and based further on game outcomes;

selecting, for the player, a plurality of player symbols to display in a bingo grid that comprises multiple rows and multiple columns, each player symbol being a symbol used in the bingo game, each player symbol corresponding to a respective symbol position of the bingo grid;

selecting a plurality of card symbols, each of which corresponds to a different respective symbol position of the bingo grid, the plurality of card symbols corresponding to a card game;

generating a user interface that displays the bingo grid populated with the plurality of player symbols, wherein the grid does not initially show any of the selected card symbols;

selecting a plurality of game symbols for the bingo game;

determining matches between the game symbols and the player symbols;

for each match between a game symbol and a player symbol, updating a display of the bingo grid to expose the card symbol corresponding to the symbol position in which the match occurs, whereby the card symbols remain hidden unless and until a bingo match occurs in a corresponding symbol position;

determining an outcome of the bingo game based on the matches between the game symbols and player symbols;

determining an outcome of the card game based on a set of card symbols exposed as a result of the matches between the game symbols and player symbols; and updating the count of gaming credits based on the outcome of the bingo game and the outcome of the card game.

2. The method of claim 1, wherein the card game is a solitaire card game.

3. The method of claim 1, wherein selecting the plurality of card symbols comprises assigning a unique card symbol to each symbol position of the grid.

4. The method of claim 1, wherein selecting the plurality of card symbols comprises assigning card symbols to symbol positions such that each column of the grid corresponds to a different respective card suit.

5. The method of claim 1, wherein selecting the plurality of card symbols comprises assigning card symbols to symbol positions such that each column of the grid corresponds to a different respective card color.

6. The method of claim 1, wherein updating a display of the bingo grid to expose the card symbol is performed at least partly in response to a user action in which the user selects a matching player symbol.

7. The method of claim 1, wherein the validation device comprises a monetary bill validator.

8. The method of claim 1, wherein the validation device comprises a token validator.

9. The method of claim 1, wherein the player symbols and game symbols are numerical values.

10. A gaming machine that implements a bingo-type game integrated with a card game, the gaming machine comprising:

a validation device configured to receive from a user, and to validate, one or more physical objects representing a value, and to determine the value associated with the one or more received physical objects;

a display device;

a controller that comprises a processor and a memory, the controller coupled to the validation device and the display device, the controller configured to maintain a count of gaming credits available to the user, the count of gaming credits based on the value of the one or more physical objects received from the user and based further on outcomes of the bingo-type game; and executable program instructions stored in the memory, wherein the executable program instructions instruct the processor to implement a process that comprises:

selecting, for the user, a plurality of player symbols to display in a bingo grid that comprises multiple rows and multiple columns, each player symbol corresponding to a respective symbol position of the bingo grid;

selecting a plurality of card symbols, each of which corresponds to a different respective symbol position of the bingo grid, the plurality of card symbols corresponding to a card game;

generating a user interface that displays, on the display device, the bingo grid populated with the plurality of player symbols, wherein the grid does not initially show any of the selected card symbols;

selecting a plurality of game symbols for the bingo game;

determining matches between the game symbols and the player symbols;

for each match between a game symbol and a player symbol, updating a display of the bingo grid to expose the card symbol corresponding to the symbol position in which the match occurs, whereby the card symbols remain hidden unless and until a bingo match occurs in a corresponding symbol position;

determining an outcome of the bingo game based on the matches between the game symbols and player symbols;

determining an outcome of the card game based on a set of card symbols exposed as a result of the matches between the game symbols and player symbols; and updating the count of gaming credits based on the outcome of the bingo game and the outcome of the card game.

11. The gaming machine of claim 10, wherein the card game is a solitaire card game.

12. The gaming machine of claim 10, wherein the card game is a solitaire card game.

13. The gaming machine of claim 10, wherein selecting the plurality of card symbols comprises assigning a unique card symbol to each symbol position of the grid.

14. The gaming machine of claim 10, wherein selecting the plurality of card symbols comprises assigning card symbols to symbol positions such that each column of the grid corresponds to a different respective card suit.

15. The gaming machine of claim 10, wherein selecting the plurality of card symbols comprises assigning card symbols to symbol positions such that each column of the grid corresponds to a different respective card color.

16. The gaming machine of claim 10, wherein updating a display of the bingo grid to expose the card symbol is performed at least partly in response to a user action in which the user selects a matching player symbol.

17. The gaming machine of claim 10, wherein the validation device comprises a monetary bill validator.

18. The gaming machine of claim 10, wherein the validation device comprises a token validator.

* * * * *